US005754202A

United States Patent [19]

Sekiya et al.

[11] Patent Number: 5,754,202

[45] Date of Patent: May 19, 1998

[54] INK JET RECORDING APPARATUS

[75] Inventors: Takuro Sekiya, Yokohama; Takayuki Yamaguchi, Minoo; Mitsuru Shingyouchi; Makoto Obu, both of Yokohama; Michio Umezawa, Kawasaki; Tetsuro Hirota, Hadano; Takesada Hirose, Machida; Hideki Ohtsuki, Fujisawa; Toshihiro Takesue, Tokyo, all of Japan

[73] Assignee: Ricoh Company, Ltd., Tokyo, Japan

[21] Appl. No.: 756,053

[22] Filed: Nov. 26, 1996

Related U.S. Application Data

[63] Continuation of Ser. No. 253,426, Jun. 2, 1994, abandoned, which is a continuation of Ser. No. 915,325, Jul. 16, 1992, abandoned.

[30] Foreign Application Priority Data

Jul. 19, 1991 [JP] Japan ..... 3-179977
Jan. 20, 1992 [JP] Japan ..... 4-007087

[51] Int. Cl.[6] ..... B41J 2/05

[52] U.S. Cl. ..... 347/63; 347/47

[58] Field of Search ..... 347/62–65, 56, 347/57, 47

[56] References Cited

U.S. PATENT DOCUMENTS

| | | | |
|---|---|---|---|
| 3,060,429 | 10/1962 | Winston | 347/82 |
| 3,416,153 | 12/1968 | Hertz | 347/73 |
| 3,596,275 | 7/1971 | Sweet | 347/74 |
| 3,747,120 | 7/1973 | Stemme | 347/70 |
| 4,313,124 | 1/1982 | Hara | 347/57 |
| 4,376,745 | 3/1983 | Hara | 347/63 |
| 4,438,191 | 3/1984 | Cloutier | 347/56 |
| 4,550,326 | 10/1985 | Allen et al. | 347/44 |
| 4,558,333 | 12/1985 | Sugitani | 347/65 |
| 4,646,105 | 2/1987 | Matsumoto | 347/57 |
| 4,683,481 | 7/1987 | Johnson | 347/65 |
| 4,723,129 | 2/1988 | Endo | 347/56 |
| 4,740,801 | 4/1988 | Shimazaki | 347/66 |
| 4,980,703 | 12/1990 | Sakurai | 347/63 |

FOREIGN PATENT DOCUMENTS

| | | | |
|---|---|---|---|
| 124311 | 11/1984 | European Pat. Off. | B41J 3/04 |
| 367541 | 5/1990 | European Pat. Off. | B41J 2/05 |
| 389738 | 10/1990 | European Pat. Off. | B41J 2/05 |
| 3018852 | 11/1980 | Germany | B41J 3/04 |
| 3248087 | 7/1983 | Germany | B41J 3/04 |
| 3402683 | 7/1983 | Germany | B41J 3/04 |
| 3347175 | 7/1984 | Germany | B41J 3/04 |
| 3402683 | 8/1984 | Germany | B41J 3/04 |
| 3618533 | 12/1986 | Germany | B41J 3/04 |
| 3717294 | 12/1987 | Germany | B41J 3/04 |
| 4141203 | 6/1992 | Germany | B41J 2/05 |
| 51-132036 | 11/1976 | Japan | B41J 3/04 |
| 5451837 | 4/1979 | Japan | B41J 3/04 |
| 5527282 | 2/1980 | Japan | B41J 3/04 |
| 5573568 | 6/1980 | Japan | B41J 3/04 |
| 5573569 | 6/1980 | Japan | B41J 3/04 |

(List continued on next page.)

OTHER PUBLICATIONS

Patent Abstracts of Japan, English-language Abstract of JP 63-182152, p. M-769.

*Primary Examiner*—Joseph W. Hartary
*Attorney, Agent, or Firm*—Cooper & Dunham LLP

[57] ABSTRACT

An ink jet recording apparatus includes a recording head for ejecting droplets of ink and a driving circuit for driving the recording head. The recording head includes a base, a plate on which a plurality of openings are formed; an ink chamber to be filled with ink being formed between the base and the plate; and heater elements, provided in the ink chamber so as to face the openings of the plate, each of which heater elements supplies heat energy to ink adjacent thereto so that the air bubble is generated on each of the heater elements and so that the air bubble grows toward a corresponding one of the openings. An area of each of the openings of the plate is greater than an area each of the heater elements. When the driving circuit activates each of the heater elements, a droplet of ink is ejected due to the air bubble from the corresponding one of the openings of the plate.

10 Claims, 24 Drawing Sheets

FOREIGN PATENT DOCUMENTS

| | | | |
|---|---|---|---|
| 55-128471 | 10/1980 | Japan | B41J 3/04 |
| 55-132258 | 10/1980 | Japan | B41J 3/04 |
| 55-132259 | 10/1980 | Japan | B41J 3/04 |
| 55-132270 | 10/1980 | Japan | B41J 3/04 |
| 59-124863 | 7/1984 | Japan | B41J 3/04 |
| 59-124864 | 7/1984 | Japan | B41J 3/04 |
| 61-189950 | 8/1986 | Japan | B41J 3/04 |
| 249768 | 11/1986 | Japan | B41J 3/04 |
| 62-253456 | 11/1987 | Japan | B41J 3/04 |
| 63-42869 | 2/1988 | Japan | B41J 3/04 |
| 63-42872 | 2/1988 | Japan | B41J 3/04 |
| 63-182152 | 7/1988 | Japan | B41J 3/04 |
| 63-197653 | 8/1988 | Japan | B41J 3/04 |
| 63-272557 | 11/1988 | Japan | B41J 3/04 |
| 63-272558 | 11/1988 | Japan | B41J 3/04 |
| 63-281853 | 11/1988 | Japan | B41J 3/04 |
| 63-281854 | 11/1988 | Japan | B41J 3/04 |
| 0167351 | 3/1989 | Japan | B41J 3/04 |
| 0110157 | 4/1989 | Japan | B41J 3/04 |
| 0197654 | 4/1989 | Japan | B41J 3/04 |
| 2155652 | 6/1990 | Japan | B41J 2/05 |

INK JET RECORDING APPARATUS

This is a continuation of application Ser. No. 08/253,426 filed Jun. 2, 1994, abandoned which in turn is a continuation of Ser. No. 07/915,325 filed Jul. 16, 1992, now abandoned.

BACKGROUND OF THE INVENTION (1) Field of the invention

The present invention generally relates to an ink jet recording apparatus and method, and more particularly to an ink jet recording apparatus in which an size of ink droplet to be ejected can be controlled and a ink jet recording method for forming an gradational image by using the above ink jet recording apparatus.

(2) Description of related art

Recently, there is growing interest in non-impact recording methods because noise generated at the time of the recording is negligibly small according to this method. Among such non-impact recording methods, the so-called ink jet recording method is an effective method because a high-speed recording is possible and the recording can be made on an ordinary paper without the need for a special fixing process. Various kinds of ink jet recording methods have been proposed in the past, and some have already been reduced to practice while others are still being modified.

The ink jet recording methods eject droplets of ink and adhere the droplets onto a recording medium such as paper. The ink jet recording methods can be categorized into several systems depending on the methods of generating the droplets of ink and the methods of controlling the ejecting direction of the droplets.

A first method is disclosed in a U.S. Pat. No. 3,060,429, for example. The first method is called Tele-type method. According to this first method, the droplets of ink are generated by electrostatic suction and the droplets are controlled by an electric field depending on a recording signal so that the droplets are selectively adhered on the recording medium. More particularly, the electric field is applied between a nozzle and an accelerating electrode, and the nozzle ejects uniformly charged droplets of ink. These droplets are ejected between x-y deflection electrodes which are electrically controlled depending on the recording signal, and the droplets are selectively adhered on the recording medium depending on the intensity change of the electric field.

A second method is disclosed in U.S. Pat. No. 3,596,275 and U.S. Pat. No. 3,298,030, for example. The second method is called Sweet method. According to the second method, charge-controlled droplets of ink are generated by a continuous vibration generating method, and the droplets are ejected between deflection electrodes applied with a uniform electric field and adhered on the recording medium. More particularly, a recording head having a piezo vibration element and a nozzle is employed, and a charging electrode applied with a recording signal is arranged in front of an orifice oc the nozzle at a predetermined distance from the orifice. An electric signal having a constant frequency is applied to the piezo vibration element so as to mechanically vibrate the piezo vibration element, and the droplets of ink are ejected via the orifice. The droplets which are ejected are charged by the charging electrode due to electrostatic induction, and the droplets are charged by an amount of dependent on the recording signal. The charge-controlled droplets are deflected depending on the amount of charge as they are ejected between deflection electrodes which apply a uniform electric field, and only the droplets which carry the recording signal are adhered on the recording medium.

A third method is disclosed in a U.S. Pat. No. 3,416,153, for example. The third method is called Hertz method. According to the third method, and electric field is applied between a nozzle and a ring-shaped charging electrode, and the droplets of ink are generated in the form of mist by the continuous vibration generating method. In other words, according to the third method, the mist state of the droplets is controlled by modulating the field intensity applied between the nozzle and the charging electrode depending on the recording signal, and the recording is made on the recording medium with gradation.

A fourth method is disclosed in a U.S. Pat. No. 3,747,120, for example. The fourth method is called Stemme method. The operating principle of the fourth method differs completely from those of the first, second and third methods described above. In other words, the first through third methods electrically control the droplets of ink ejected from the nozzle, and the droplets carrying the recording signal are selectively adhered on the recording medium. But according to the fourth method, the droplets of ink are ejected from the nozzle depending on the recording signal. That is, the electric recording signal is applied to the piezo vibration element of the recording head which has the nozzle so as to convert the electric recording signal into the mechanical vibration of the piezo vibration element, and the droplets of ink are ejected from the nozzle depending on this mechanical vibration so as to adhere the droplets on recording medium.

However, each of the four methods described above have problems to be solved, as will be described hereinafter.

According to the first through third methods, the droplets of ink are generated directly from electrical energy, and the deflection control of the droplets is made by the electric field. For this reason, the first method uses a simple construction, by a large voltage is required to generate small droplets of ink. In addition, the first method is unsuited for a high-speed recording because it is difficult to provide a multi-nozzle on the recording head.

As for the second method, high-speed recording is possible because the multi-nozzle may be provided on the recording head. However, the construction needed to generate the droplets of ink becomes complex, and it is difficult to electrically control the small droplets. Furthermore, the so-called satellite dots are easily formed on the recording medium.

The third method can record a satisfactory image with gradation by forming a mist of the droplets of ink. But in this case, it is difficult to control the mist state, and smear is easily formed on the recording medium. Furthermore, it is difficult to provide the multi-nozzle on the recording head, and the third method is unsuited for carrying out the high-speed recording.

Compared to the first through third methods,the fourth method has a relatively large number of advantageous points. In other words, the fourth method uses a simple construction. In addition, since the droplets of ink are ejected from the nozzle in an on-demand manner, it is unnecessary to recover the droplets which are not used for the recording, unlike the first through third methods. Moreover, unlike the first through third methods, the fourth method does not require the use of a conductive ink, and the material and composition of the ink can be selected with a large degree of freedom. But on the other hand, it is difficult to form the recording head required by the fourth method. Furthermore, it is difficult to provide the multi-nozzle on the recording head because the downsizing of the piezo vibration element having a desired resonance frequency is extremely difficult. The fourth method is also unsuited for carrying out the high-speed recording because the droplets of ink are ejected by the mechanical energy, that is, the mechanical vibration of the piezo vibration element.

Therefor, there is a problem in that the first through fourth methods can only be used in applications where the disadvantages of each method can substantially be neglected.

An ink jet recording apparatus has been previously proposed in a Japanese Laid Open Patent Application No. 54-51837 to reduce the problems described above. According to this proposed ink jet recording apparatus, the ink within an ink chamber is heated so as to generate air bubbles and the pressure of the ink is increased. As a result, the ink is ejected from a fine capillary tube nozzle and transferred onto a recording medium such as paper. Using the operation principle of this proposed ink jet recording apparatus, various modifications have been made.

A Japanese Laid Open Patent application No. 55-27282 proposes one of such modifications.

According to this method, a part of the ink in a flow path connected to an opening is heated and boiled, and droplets are ejected via the opening in a predetermined direction. As a result, the droplets of ink fly and are adhered on the recording medium so that the recording of images is carried out on the recording medium. More particularly, as shown in FIGS. 1 and 2 of the above-identified Patent Application, a state changing of the ink on a heater portion provided in the nozzle-shaped flow path rapidly occurs due to the heating operation of the heater portion. Then, droplets of ink are ejected from the opening by an action force depending on the state changing of the ink.

A description will now be given, with reference to FIG. 1, of the operating principle of the above method.

In FIG. 1, (*a*) shows a stationary state in which the surface tension of ink 1 at an orifice surface is balanced with the external pressure.

In FIG. 1, (*b*) shows a state in which a surface temperature of a heater 2 rises rapidly to temperature at which the boiling phenomenon occurs in the ink layer adjacent to the heater 2 and the ink 1 is studded with fine air bubbles 3.

In FIG. 1, (*c*) shows a state in which the rapidly heated ink layer instantaneously evaporates on the entire surface of the heater 2 to form a boiling film and the air bubble 3 is grown. In this state, the pressure within the nozzle is raised by the amount by which the air bubble 3 grown. For this reason, the surface tension at the orifice surface and the external pressure become unbalanced, and a column 5 of the ink 3 starts to grow at the orifice.

In FIG. 1, (*d*) shows a state in which the air bubble 3 is grown to a maximum and an amount of the ink 1 corresponding to the volume of the air bubble 3 is pushed out from the orifice surface. In this state, on current is supplied to the heater 2 and the surface temperature of the heater 2 is about to fall. The volume of the air bubble 3 reaches the maximum value at a time which is slightly delayed from the time when an electrical pulse is applied to the heater 2.

In FIG. 1, (*e*) shows a state in which the air bubble 3 is cooled by the ink 1 and the like and starts to contract. The tip end part of the ink column continues to move to the left in FIG.1 while maintaining the velocity at which the ink 1 is pushed out from the orifice. On the other hand, a constriction is formed in the ink column at the rear end part of the ink column because the pressure within the nozzle decreases due to the contraction of the air bubble 3 and the ink flows backward into the nozzle from the orifice surface.

In FIG. 1, (*f*) shows a state in which the air bubble 3 further contract and ink 1 makes contract with the heater surface thereby further and rapidly cooling the heater surface. At the orifice surface, the meniscus is large because the external pressure becomes higher than the pressure within the nozzle, and the meniscus enters within the nozzle. The tip end part of the ink column becomes a droplet and is ejected towards the recording paper at a velocity of approximately 5 to 10 m/sec.

In FIG. 1, (*g*) shows a state in which the ink 1 is refilled to the orifice by the capillary phenomena and the air bubble 3 is completely eliminated. This state (g) corresponds to the process of returning to the initial state shown in (a).

FIG. 2 is a partially cutaway perspective view illustrating a bubble jet type ink jet recording head 6 operating in accordance with the above processes shown in FIG. 1. This ink jet recording head 6 is generally called an Edge Shooter. In the ink jet recording head 6 shown in FIG. 2, the air bubble 3 is generated and grown in the nozzle 4 and the droplet 5 of ink is ejected from the orifice of the nozzle 4.

FIG. 3 is a partially cutaway perspective view illustrating a recording head 7 which is called a Side Shooter. In this recording head 7 shown in FIG. 3, the nozzle 4 extends in a direction in which the air bubble 3 is grown. The recording head 7 ejects the droplet 5 of ink in accordance with processes shown in FIG. 4. Processes shown by (a) (b) and (c) in FIG. 4 correspond to those shown by (a) (b) (c) and (d) in FIG. 1, and processes shown by (d) and (e) in FIG. 4 correspond to those shown by (f) and (g) in FIG. 1.

In the processes shown in FIGS. 1 and 2, there is a feature in that a film boiling phenomena is utilized in processes shown by (b) through (d) in FIG. 1 and shown by (b) and (c) in FIG. 4. Thus, a recording head operating in accordance with the above processes is needed to enable to regularly control generation and disappearance of the boiling film in the ink. The film boiling phenomena can occur in the following cases;

1) a case where a substance heated to a high temperature soaks in liquid; and
2) a case where a temperature of a substance in contact with liquid rapidly rises. A case where the film boiling phenomena periodically occurs on the heater 2 corresponds to the above case 2).

FIGS. 5A and 5B show relationships between a pulse widths supplied to the heater and the shapes of the air bubble 3 generated by heating. In a case where a narrow pulse having a width equal to or less than 10 μsec. is supplied to the heater 2, the heater 2 is rapidly heated and the ink reaches a heating limit before bubbling cores are generated. Thus, a film-shaped air bubble 3*a* is generated on the heater 2, as shown in FIG. 5A. In this case, at a count, the adiabatic expansion of the air bubble 3*a* is performed under a condition where an internal pressure thereof is maintained at 15 $kg/cm^2$, and the ink is pushed out from the nozzle. When the air bubble reaches a maximum size, the ink stops to be heated. Then the air bubble is cooled and disappeared.

In a case where the ink is gradually heated, the normal boiling phenomena starts from the bubbling cores on the surface of the heater 2, and unspecific air bubbles 3*b* and a fixed air bubble 3*c* are generated on the heater 2, as shown in FIG. 5B. In this case, it is impossible to stably repeat controls of size and disappearance of air bubbles.

Due to generating the film boiling on the surface of the heater 2, the size of the air bubble is controlled uniformly and stably, and a heating loss in the ink is small. When the air bubble reaches the maximum volume, the ink surrounding the air bubble has been already cooled. Thus, the air bubble is rapidly contracted, so that the generation and disappearance of the bubble can be repeated at a high speed with a good frequency responsibility. The film boiling phenomenon can be utilized for a driving source of ejection of droplets of ink in a on-demand type ink jet recording head.

In the above method, a characteristic by which the droplets of ink are ejected depends on the size of the air bubble generated in the ink. The size of the air bubble does not depend on a voltage supplied to the heater 2. The size of the air bubble depends on a size of the heater 2 and a structure of the nozzle.

The orifice of the nozzle is formed in accordance with a process disclosed, for example, in Japanese Laid Open Patent Application No. 55-27282. That is, a cylindrical glass fiber having an internal diameter of 100 μm and a thickness of 10 μm is melted, and an orifice of 60 μm is formed. In the above reference, a product process is disclosed in which orifices are formed on a glass plate by an electron-beam machining, laser-beam machining or the like, and then flow paths and the orifices are connected to each other. However, it is difficult to stably product fine orifices.

The above reference (Japanese Laid Open Patent Application No. 55-27282) discloses an ink jet recording head having other orifices in the FIGS. 3, 4 and 5. These orifices are formed as follows. Grooves each having a width of 60 μm and a depth of 60 μm are formed at a pitch of 250 μm on a plate made of glass by a fine cutting machine. The plate on which the grooves are formed is adhered to a base plate on which electrothermal energy conversion elements are formed, each of grooves corresponding to one of the electrothermal energy conversion elements. However, in this ink jet recording head, the orifices should be minutely formed, and the plate easily cracked when the grooves are formed on the plate by the fine cutting machine. It is difficult to minutely form the orifices.

Japanese Laid open Patent Applications No. 55-128471 and No. 55-132270 disclose methods of making the ink jet recording head. The ink jet recording head disclosed in Japanese Laid Open Patent Application No. 55-128471 has narrow flow paths for ink and orifices each coupled to one of the narrow flow paths. Droplets of ink is ejected from each of the narrow flow paths via a corresponding orifice. The droplets ejected via each of the orifices are adhered on the recording medium, so that an image is formed on the recording medium. The ink jet recording head disclosed in Japanese Laid Open Patent Application No. 55-132270 has narrow flow paths for ink, orifices each coupled to one of the narrow flow paths and having a diameter of d, and heating portions each provided in one of the narrow paths. Each of the heating portion is positioned at a position within a range between d–50d distant from a corresponding orifice.

In methods for making the above ink jet recording head disclosed in Japanese Laid Open Patent Application No. 55-128471 and No. 55-132270, a plate made of photosensitive glass on which narrow grooves are formed by etching and a plate on which heating resistance elements are formed are adhered to each other, so that orifices each of which is coupled to a corresponding one of the grooves are formed. Each of the orifices is minute, and size of each orifice is generally in a range of 30–50 μm. Thus, there are cases where the orifices are clogged with impurity included in the ink and refuse generated in an ink supplying system and the the flow path.

Japanese Laid Open Patent Applications No. 62-253456, No. 63-182152, No. 63-197653, No. 63-272557, No. 63-272558, No. 63-281853, No. 63-281854, No. 64-67351, and No. 1-97654 disclose ink jet recording heads. These ink jet recording heads utilize a slit plate having a slit substituted for the orifices described above. The width of the slit is minute, for example, a tens um. Thus, these ink jet recording heads have the same problem, as that having orifices, in that the slit is clogged with the impurity of the ink and the refuse. In addition, in these ink jet recording heads, a plurality of heating elements correspond to one slit. Thus, when heating elements adjacent to each other are simultaneously driven, ejections of droplets of ink at adjacent parts are interfered with each other. That is, a cross talk occurs.

Japanese Laid Open Patent Application No. 51-132036 and No. 1-101157 disclose ink jet recording heads having neither orifices nor a slit. In the ink jet recording head disclosed in Japanese Laid Open Patent Application No. 51-132036, droplets of ink are jetted by a force generated when air bubbles are exploded in the ink. In the ink jet recording head disclosed in Japanese Laid Open Application No. 1-101157, an electric power is supplied to each heating element so that the ink thereon is boiled in a moment, and mist of ink is jetted from the ink jet recording head. However, according to the above ink jet recording heads, an image formed on the recording medium is easily smeared by the mist of the ink, so that the quality of the image deteriorates.

Japanese Laid Open Patent Application No. 55-27282 discloses an ink jet recording head for recording a binary image. This ink jet recording head can not control the size of each dot in the binary image because the amount of ink in each droplet can not be controlled. On the other hand, Japanese Laid Open Patent Application NO. 55-132258 proposes an ink jet recording head in which a multilevel recording can be carried out by controlling the amount of ink in each droplet. In this ink jet recording head, each heating part (an electric-to-heat conversion element) has a structure by which the amount of heat transmitted to the ink can be controlled, as shown in FIGS. 6A–6C.

FIGS. 6A–6C are cross sectional views showing structures of electric-to-heat conversion elements. Referring to FIGS. 6A–6C, each electric-to-heat conversion element has a substrate 8, a heat storage layer 9 stacked on the substrate 8, a heat layer 10 formed on the heat storage layer 9, electrodes 11 and 12 connected to the heat layer 10, and a protection layer covering the electrodes 11 and 12 and the heater layer 10.

In the electric-to-heat conversion element shown in FIG. 6A, the thickness of the protection layer 13 gradually increases from a position A close to the electrode 12 to a position B close to the electrode 11. As a result, the amount of heat transmitted for unit time from a heating area ΔL to the ink thereon varies depending on a position in a direction from the electrode 12 to the electrode 11.

In the electric-to-heat conversion element shown in FIG. 6B, the thickness of the heat storage layer 9 gradually decreases from a point A to a point B in a heating area ΔL. According to the structure shown in FIG. 6B, the amount of heat radiated to the substrate 8 via the heat storage layer 8 increases from the position A to the position B in the heating area ΔL. As a result, the amount of heat transmitted for unit time to the ink on the heating area ΔL decreases from the position B to the position A.

In the electric-to-heat conversion element shown in FIG. 6C, the thickness of the heat layer 10 gradually increases from a position close to the electrode 12 to a position B close to the electrode 11 in the heating area ΔL. In this case, the resistance of the heat layer 10 gradually decreases from the position A from the position B. As a result, the amount of heat transmitted for unit time to the ink on the heating area ΔL decreases from the position A to the position B.

According to each of the electric-to-heat conversion elements shown in FIGS. 6A–6C, an area where the amount of heat needed to generate an air bubble is transmitted to the ink thereon can be controlled in accordance with the level of electric power supplied to the heat layer 10 via the electrodes 11 and 12. That is, the size of an air bubble formed on the heating area ΔL is controlled in accordance with the electric power supplied to the heater layer 10. Thus, the amount of ink in each droplet can be controlled in accordance with the electric power (corresponding to image data) supplied to the heat layer 10.

Japanese Laid Open Patent Application No. 55-132258 also discloses structures of the electric-to-heat conversion elements as shown in FIGS. 7A–7E. FIGS. 7A–7E are plane views illustrating electric-to-heat conversion elements.

Referring to FIGS. 7A–7E, each of the electric-to-heat conversion element has a heating portion 15 and electrodes 16 and 17 connected to the heating portion 15. In the electric-to-heat conversion element shown in FIG. 7A, the heating portion 15 is rectangular and the width of the electrode 16 connected to an edge A of the heating portion 15 is less than the of the electrode 17 connected to an edge B of the heating portion 15. In the electric-to-heat conversion elements shown in FIGS. 7B and 7C, the width of the heating portion gradually decreases from the edges A thereof to the center B thereof. In the electric-to-heat conversion element shown in FIG. 7D, the width of the heating portion 15 gradually increases from the edge A thereof to the edge B thereof so that the heating portion 15 is trapeziform. The electrodes 16 and 17 are connected to edges of the heating portion 15 which edges extend between the edges A and B. In the electric-to-heat conversion element shown in FIG. 7E, the with of the heating portion 15 gradually increases from the edges A to the center thereof.

According to each of the electric-to-heat conversion elements shown in FIGS. 7A–7E, a current density in the heating portion 15 decreases from A to B. In this case, an area where the amount of heat needed to generate an air bubble is transmitted to the ink on the heating portion 15 is controlled in accordance with the level of the electric power supplied to the heating portion 15. That is, the size of the air bubble formed on the heating portion 15 can be controlled in accordance with the electric power supplied to the heating portion 15. Thus, the amount of the ink ink each droplet ejected from the ink jet recording head is controlled, so that a multilevel image can be formed on the recording medium.

However, it is difficult to form a layer whose thickness gradually varies as shown in FIGS. 6A–6C. That is, it is difficult to make an ink jet recording head having a structure as shown in FIGS. 6A–6C. In addition, since the heating portion 15 as shown in FIGS. 7A–7E has a narrow part B, when the electric power is supplied to the heating portion 15, the heating portion is disconnected at the narrow part B easily. Thus, the ink jet recording head having the structure as shown in FIGS. 7A–7E has the poor durability and reliability.

Japanese Laid Open Patent Application No. 63-42872 discloses an ink jet recording head in which the multilevel recording can be carried out by using the electric-to-heat conversion element having the same structure as that shown in FIGS. 6A–6C. Thus, it is also difficult to make this ink jet recording head.

Japanese Laid Open Patent Applications No. 55-73568, No. 55-73569 and No. 55-132259 disclose other ink jet recording apparatus in which the multilevel images can be formed. In these ink jet recording apparatus, a plurality of heating elements corresponding to one nozzle are provided. The number of heating elements to which the electric power is supplied is controlled, or the order of heating elements to which the electric power is supplied is controlled, so that the size of air bubble formed on the heating elements is controlled. However, since a plurality of the heating elements are provided corresponding to one nozzle, the number of electrodes of the heating elements increases. Thus, a large number of nozzles are hardly arranged in a predetermined distance.

Japanese Laid Open Patent Applications No. 59-124863 and No. 59-124864 discloses ink jet recording heads having heating elements for ejecting droplets of the ink and other heating elements for generating air bubbles in the ink. In these recording head, the amount of ink in each droplet can be controlled. However, since two heating elements are required for ejecting a droplet of the ink, a large number of nozzles are hardly arranged in a predetermined distance.

Japanese Laid Open Patent Application No. 63-42869 disclose an ink jet recording head in which a time for which an electric power is supplied to each heating element is controlled so that the times of generating of the air bubbles is controlled. As a result, the amount of ink in each droplet is controlled. However, the time for which the electric power is supplied to each heating portion is generally limited to a value within a range between several μsec and several tens μsec. If the electric power is supplied to the heating element for a time greater than the value within the range, the heating element can be broken due to the electric power having the too mach value. Thus, the durability and reliability of this ink jet recording head are poor.

SUMMARY OF THE INVENTION

Accordingly, a general object of the present invention is to provide a novel and useful ink jet recording apparatus and method in which the disadvantages of the aforementioned prior art are eliminated.

A more specific object of the present invention is to provide an ink jet recording apparatus and method in which the durability and reliability are improved.

Another object of the present invention is to provide an ink jet recording apparatus and method in which the size of each dot can be controlled so that multilevel images can be easily formed on a recording medium.

The above objects of the present invention are achieved by an ink jet recording apparatus comprising: a recording head including, a base, a plate on which a plurality of openings are formed, an ink chamber to be filled with ink being formed between the base and the plate, and bubble generating means, provided in the ink chamber so as to face each of the openings of the plate, for generating an air bubble in the ink in the ink chamber, the bubble generating means, having an operating area facing a corresponding one of the openings, for supplying heat energy to ink adjacent to the operating area so that the air bubble is generated on the operating area and so that the air bubble grows toward the corresponding one of the openings; and driving means, coupled to the recording head, for activating the bubble generating means in accordance with image data supplied from an external unit; wherein an area of each of the openings of the plate is greater than the operating area of the bubble generating means, and wherein, when the driving means activates the bubble generating means, a droplet of ink is ejected, due to the air bubble, from the corresponding one of the openings of the plate.

The above objects of the present invention are achieved by an ink jet recording method for jetting droplets of ink from a recording head comprising, a base; a plate on which a plurality of openings are formed, the plate being maintained so as to be approximately parallel to the base at a predetermined distance; an ink chamber to be filled with ink being formed between the base and the plate; and bubble generating means, provided in the ink chamber so as to face each of the openings of the plate, for generating an air bubble in the ink in the ink chamber, the bubble generating means, having an operating area facing a corresponding one of the openings, for supplying heat energy to ink adjacent to the operating area so that the air bubble is generated on the operating area and so that the air bubble grows toward the corresponding one of the openings; the method comprising the steps of: (a) generating an air bubble in the operating area of the bubble generating means; (b) growing the air bubble in the operating area of the bubble generating means so that the air bubble projects from a rim of a corresponding one of the openings of the plate; and (c) contracting the air bubble, a droplet of the ink being ejected from the corresponding one of the openings of the plate when the air bubble is made to contract, the droplet thus being projected to a recording medium and being adhered thereon so that a dot image is formed on the recording medium.

According to the present invention, since the are of each of the openings from which droplets of the ink are jetted is greater than the operation area of the bubble generating means, the durability and reliability of the ink jet recording apparatus are improved.

In addition, the air bubble is grown so as to be projected from each of the openings on the plate. The height of the air bubble is controlled by the amount of heat energy supplied to the ink. The height of the air bubble corresponds to the amount of ink in a droplet ejected from each of the openings. Thus, the amount of ink in the droplet of the ink can be controlled by the amount of heat energy supplied to the ink. That is, the size of each dot can be controlled so that multilevel images can be easily formed on a recording medium.

Additional objects, features and advantages of the present invention will become apparent from the following detailed description when read in conjunction with the accompanying drawings.

DESCRIPTION OF THE PREFERRED EMBODIMENTS

A description will now be given, with reference to FIGS. 8 through 18, of a first embodiment of the present invention.

Figure 1A:
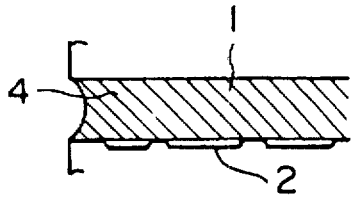
FIG. 1A PRIOR ART
FIGS. 1(*a*)–1(*g*) are a diagram illustrating a process for ejecting droplets of ink from an ink jet recording head.
Figure 1B:
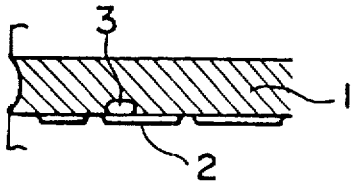
FIG. 1B PRIOR ART
Figure 1C:
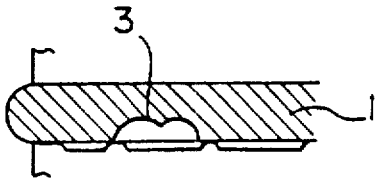
FIG. 1C PRIOR ART
Figure 1D:
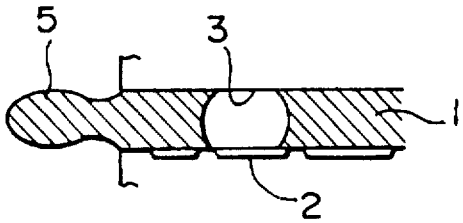
FIG. 1D PRIOR ART
Figure 1E:
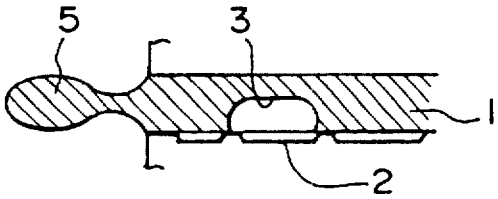
FIG. 1E PRIOR ART
Figure 1F:
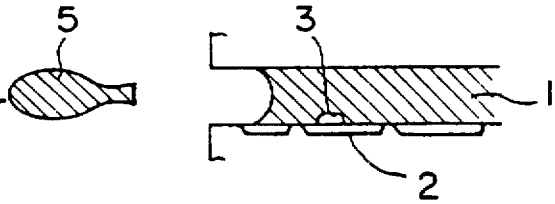
FIG. 1F PRIOR ART
Figure 1G:
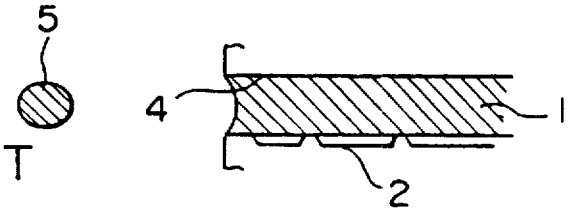
FIG. 1G PRIOR ART
Figure 2:
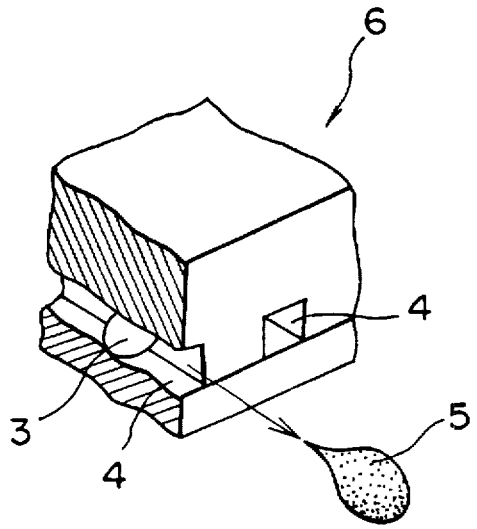
FIG. 2 PRIOR ART
FIG. 2 is a perspective view illustrating an example of a structure of an ink jet recording head.
Figure 3:
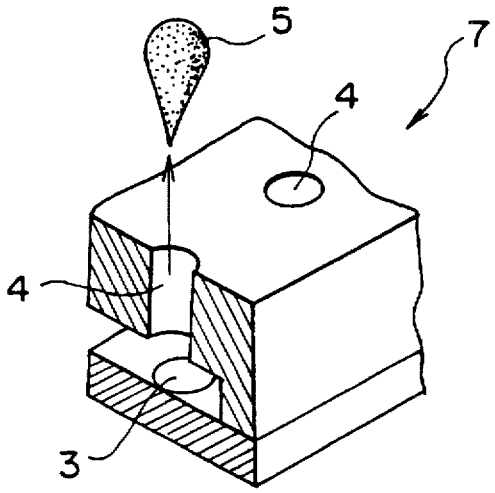
FIG. 3 PRIOR ART
FIG. 3 is a perspective view illustrating another example of a structure of an ink jet recording head.
Figure 4A:
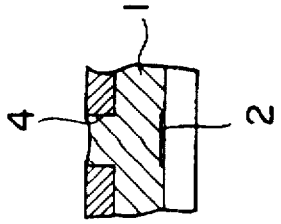
FIG.4A PRIOR ART
FIGS. 4(*a*)–4(*e*) are a diagram illustrating a process for ejecting droplets of ink from an ink jet recording head having the structure shown in FIG. 3.
Figure 4B:
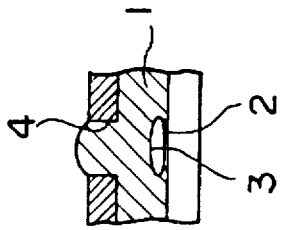
FIG.4B PRIOR ART
Figure 4C:
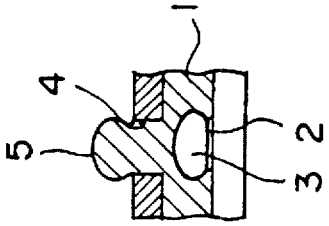
FIG.4C PRIOR ART
Figure 4D:
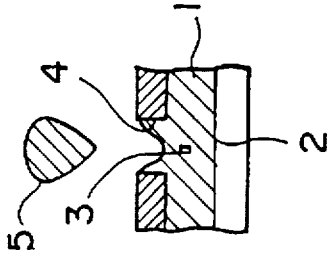
FIG.4D PRIOR ART
Figure 4E:
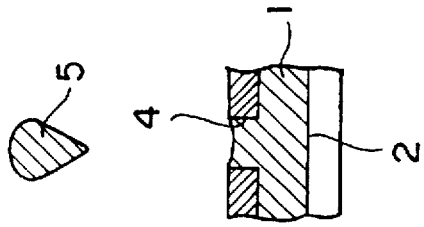
FIG.4E PRIOR ART
Figure 5A:
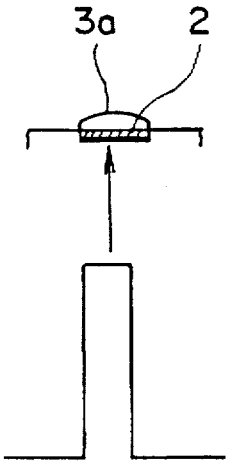
FIG. 5A PRIOR ART
FIGS. 5A and 5B are diagrams illustrating a process for generating air bubbles in ink.
Figure 5B:
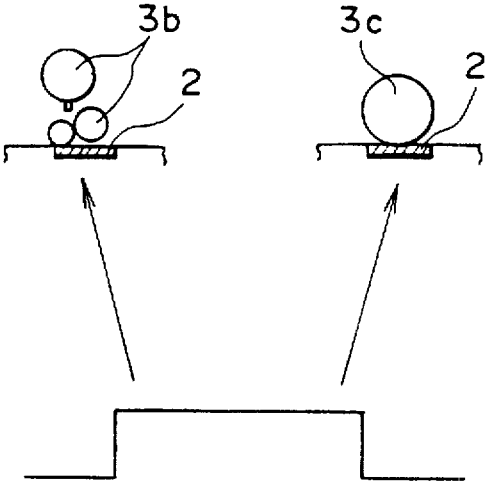
FIG. 5B PRIOR ART
Figure 6A:
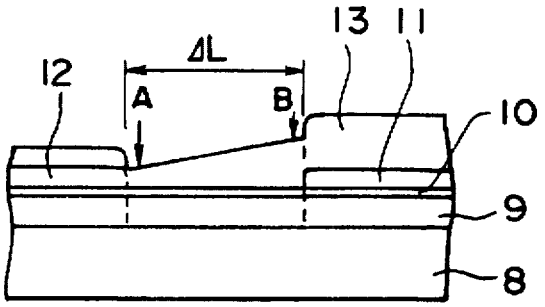
FIG. 6A PRIOR ART
FIGS. 6A, 6B and 6C are diagrams illustrating examples of electric-to-heat conversion elements provided in the ink jet recording head.
Figure 6B:
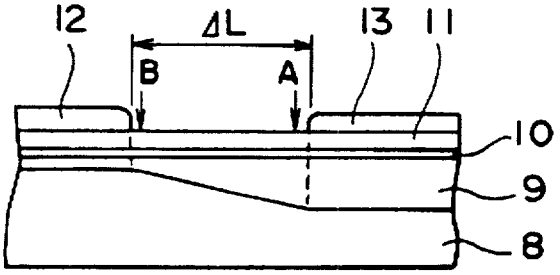
FIG. 6B PRIOR ART
Figure 6C:
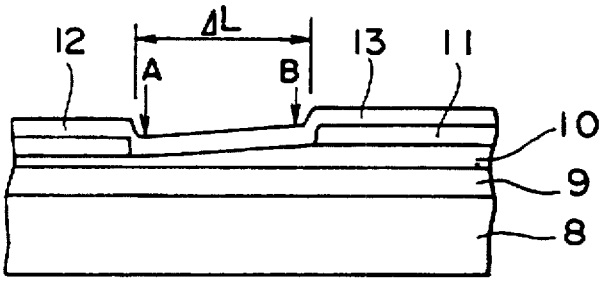
FIG. 6C PRIOR ART
Figure 7A:
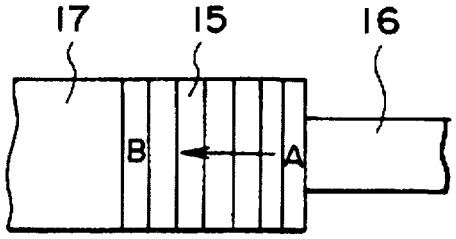
FIG. 7A PRIOR ART
FIGS. 7A, 7B, 7C, 7D and 7E are diagrams illustrating other examples of electric-to-heat conversion elements provided in the ink jet recording head.
Figure 7B:
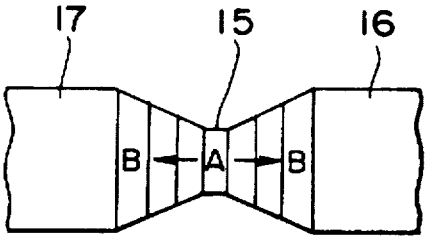
FIG. 7B PRIOR ART
Figure 7C:
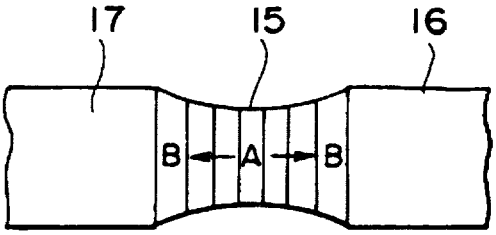
FIG. 7C PRIOR ART
Figure 7D:
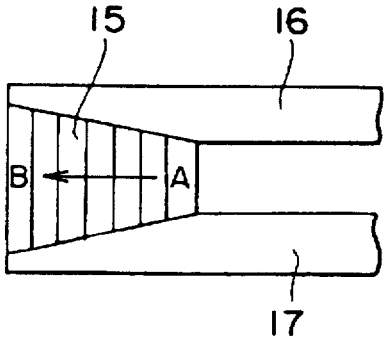
FIG. 7D PRIOR ART
Figure 7E:
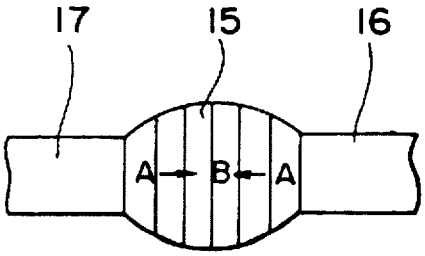
FIG. 7E PRIOR ART
Figure 8A:
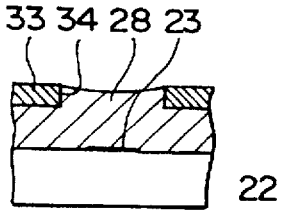
FIG.8A PRIOR ART
FIGS. 8(*a*)–8*l* are a diagram illustrating a process for ejecting droplets of ink from an ink jet recording head according to the present invention.
Figure 8B:
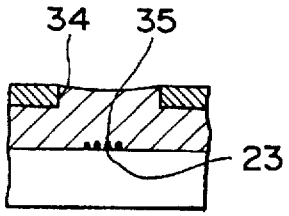
FIG.8B PRIOR ART
Figure 8C:
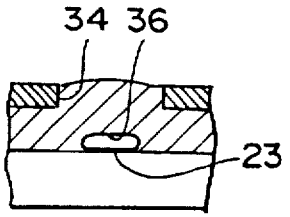
FIG.8C PRIOR ART
Figure 8D:
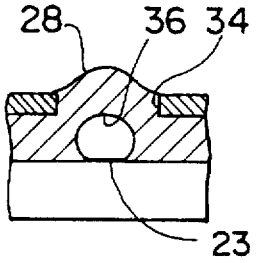
FIG.8D PRIOR ART
Figure 8E:
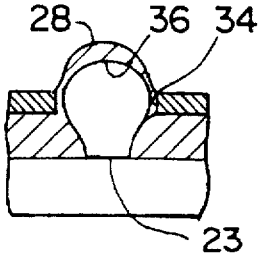
FIG.8E PRIOR ART
Figure 8F:
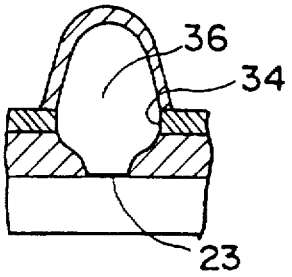
FIG.8F PRIOR ART
Figure 8G:
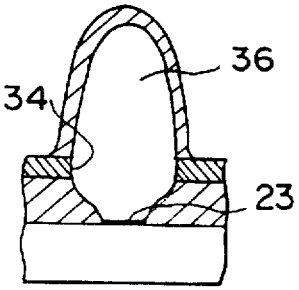
FIG.8G PRIOR ART
Figure 8H:
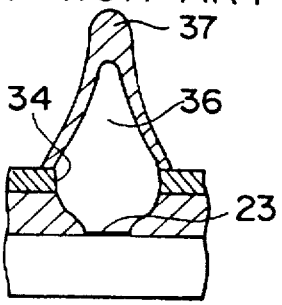
FIG.8H PRIOR ART
Figure 8I:
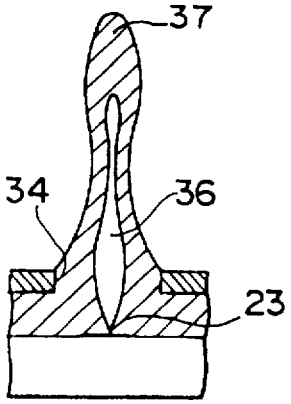
FIG.8I PRIOR ART
Figure 8J:
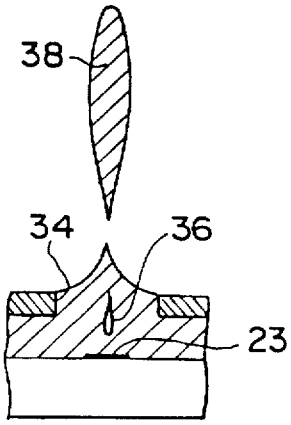
FIG.8J PRIOR ART
Figure 8K:
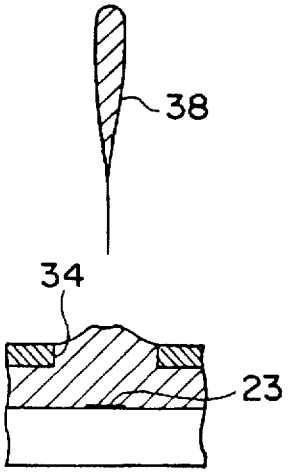
FIG.8K PRIOR ART
Figure 8L:
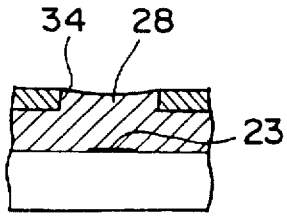
FIG.8L PRIOR ART
Figure 9:
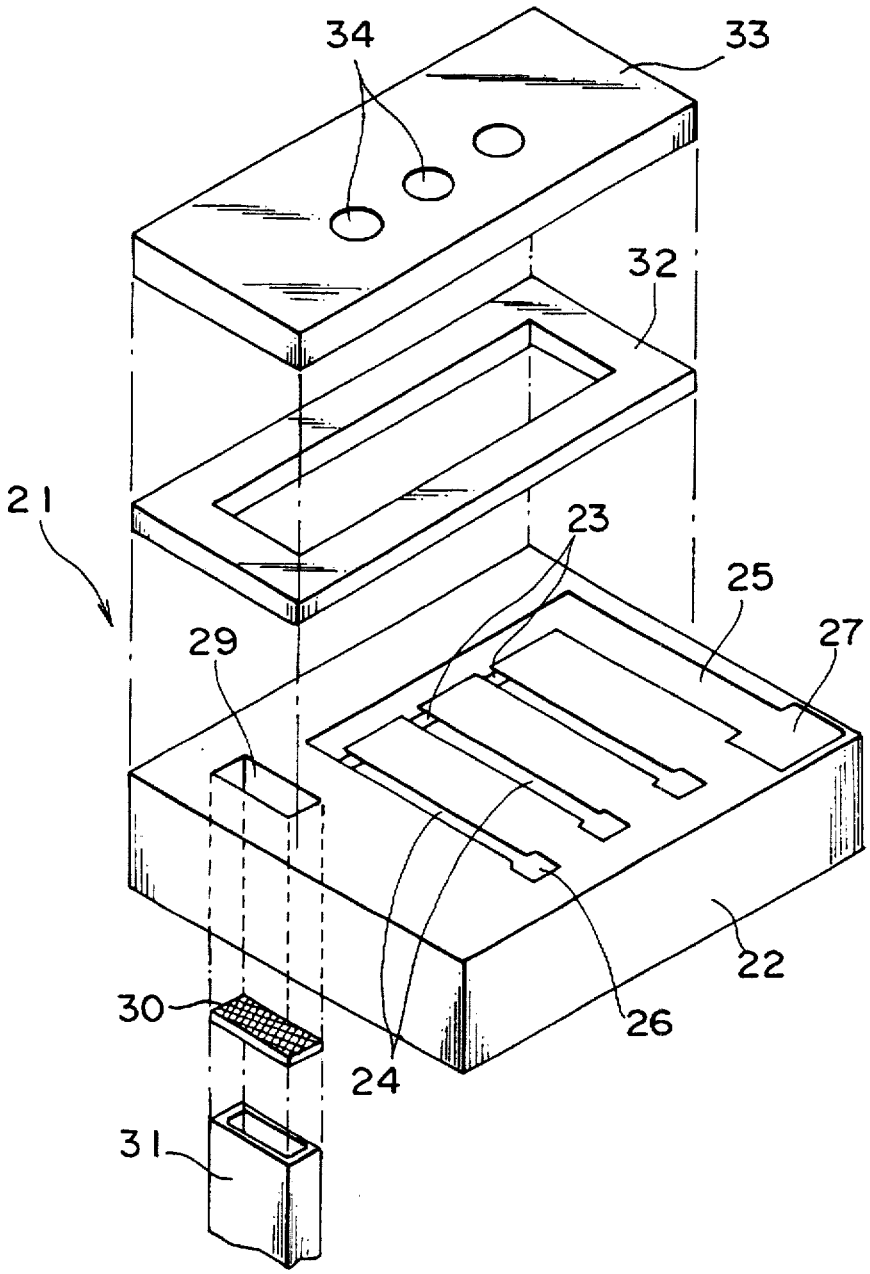
FIG. 9 is a exploded perspective view illustrating an ink jet recording head according to a first embodiment of the present invention.
Figure 10:
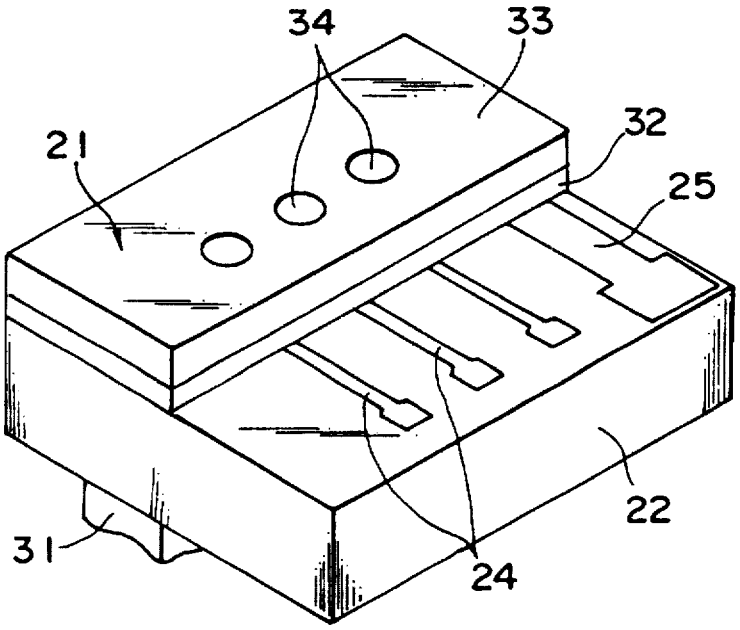
FIG. 10 is a perspective view illustrating the ink jet recording head according to the present invention.

FIG. 9 shows parts of an ink jet recording head and FIG. 10 shows a finished ink jet recording head. Referred to FIGS. 9 and 10, a plurality of heater elements 23 are provided on a substrate 22 so as to be arranged in a line. Each of the heater element 23 operates as an energy operating part from which heat energy is supplied to the ink.

Individual control electrodes 24 and a common electrode 25 are formed on the substrate 22. A first end of each of the individual control electrodes 24 is connected to a first side of a corresponding one of the heater elements 23. A first end of the common electrode 25 is connected to second sides of respective heater elements 23. The individual control electrodes 24 and the common electrode 25 extend toward a predetermined side of the substrate 22. Bonding pads 26 and 27 are respectively formed at a second end of each of the individual control electrodes 24 and a second end of the common electrode 25. An ink intake 29 is formed at a position abreast of the heater elements 23 on the substrate 22 so as to penetrate the substrate 22. The ink intake 29 is connected to an ink tube 31 via a filter 30. A spacer 32 which is a rectangular frame is provided on the substrate 22 so as to surround the heater elements 23 and the ink intake 29. A plate 33 is provided on the spacer 32 so that a space surrounded by the substrate 22, the spacer 32 and the plate 33 is formed as an ink chamber. The spacer 32 maintains the substrate 22 and the plate 33 being parallel to each other. The plate 33 has a plurality of openings 34 arranged in a line so that each of the openings 34 faces a corresponding one of the heater elements 23. An area of each of the openings 34 is greater than that of a heating part of a corresponding one of the heater elements 23.

Figure 11:
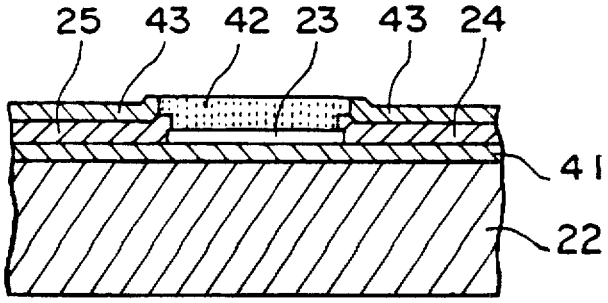
FIG. 11 is a cross sectional view illustrating a heating portion of the ink jet recording head according to the present invention.
Figure 12A:
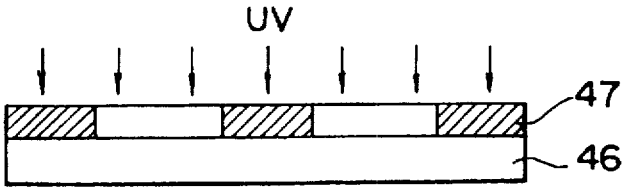
FIG.12A PRIOR ART
FIGS. 12(*a*)–12(*f*), 13(*a*)–13(*f*), 14(*a*)–14(*f*) and 15 are diagrams illustrating examples of a process for forming the plate on which the openings are formed.
Figure 12B:
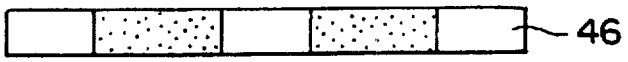
FIG.12B PRIOR ART
Figure 12C:
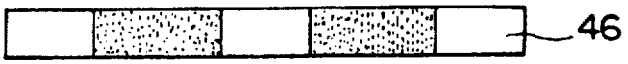
FIG.12C PRIOR ART
Figure 12D:
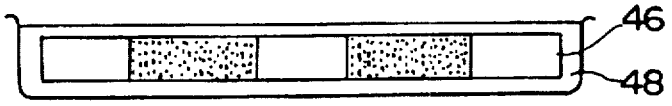
FIG.12D PRIOR ART
Figure 12E:
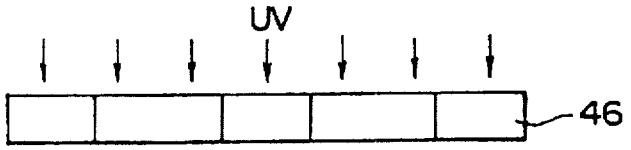
FIG.12E PRIOR ART
Figure 12F:
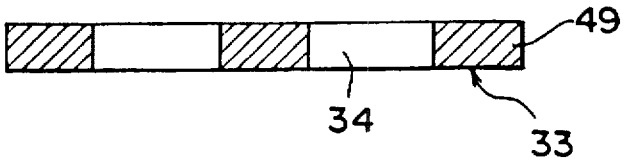
FIG.12F PRIOR ART
Figure 13A:
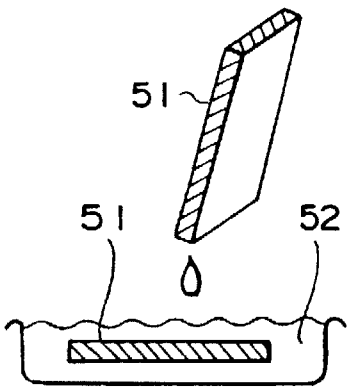
FIG.13A PRIOR ART
Figure 13B:
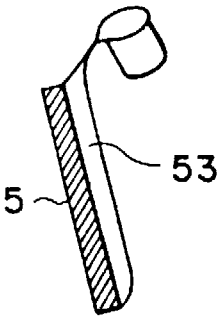
FIG.13B PRIOR ART
Figure 13C:
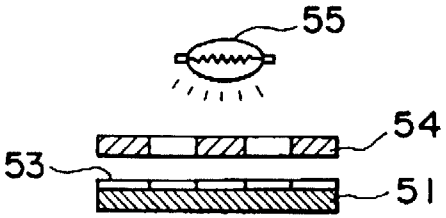
FIG.13C PRIOR ART
Figure 13D:
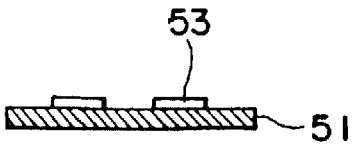
FIG.13D PRIOR ART
Figure 13E:
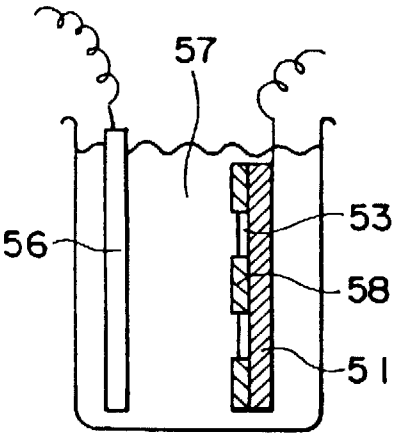
FIG.13E PRIOR ART
Figure 13F:
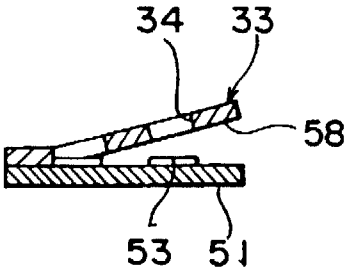
FIG.13F PRIOR ART
Figure 14A:
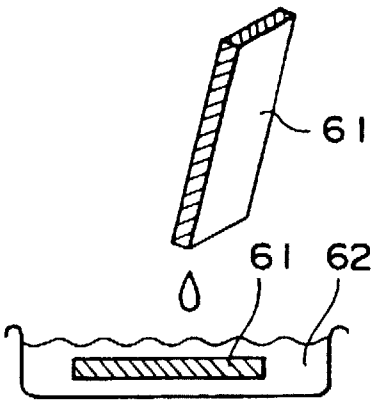
FIG.14A PRIOR ART
Figure 14B:
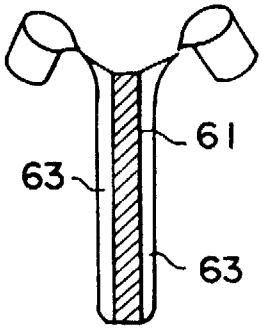
FIG.14B PRIOR ART
Figure 14C:
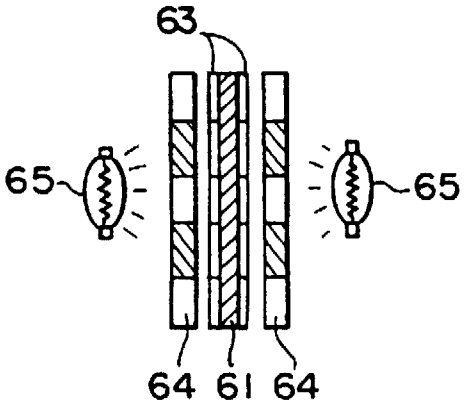
FIG.14C PRIOR ART
Figure 14D:
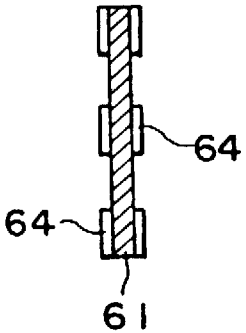
FIG.14D PRIOR ART
Figure 14E:
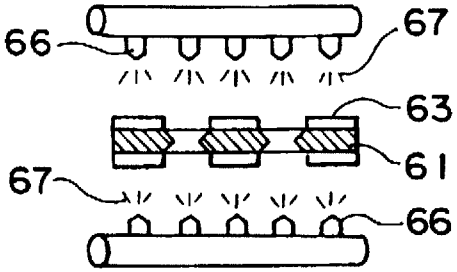
FIG.14E PRIOR ART
Figure 14F:
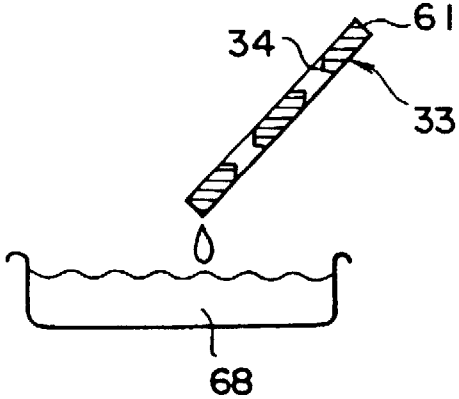
FIG.14F PRIOR ART

In FIGS. 9 and 10 and other figures, for the sake of simplicity of description, some parts of each structure are omitted at need. In FIG. 11 indicating a structure of the ink jet recording head having the substrate 22, the heater element 23, the electrodes 24 and 25 and the like, a heat storage layer, a protection layer and other layers are omitted. In addition, in FIGS. 9 and 10, three heater elements 23 and three openings 34, but each of the numbers of the heater elements 23 and the openings 34 in an actual ink jet recording head is more than three. A low-end serial printer has, for example, 64–256 heater elements, and a high-end multi-printer has, for example, 2000–4000 heater elements. The greater the number of the heater elements, the greater the number or area of the ink intakes formed on the substrate 22.

The ink jet recording head as shown in FIGS. 9 and 10 ejects droplets of ink in accordance with the following process shown in FIG. 8. A description will now be given of the operation of the ink jet recording head with reference to FIG. 8.

In FIG. 8, (*a*) shows a stationary state in which the ink 28 covers the heater element 23, and the surface of the ink 28 is held by the meniscus holding force at the opening 34.

In FIG. 8, (*b*) shows a state in which an electric power is supplied to the heater element 23 and the surface temperature of the heater element 23 raises rapidly to a temperature at which the film boiling phenomena occurs in the ink layer. In this state, the ink 28 is studded with fine air bubbles 35.

FIG. 8, (*c*) shows a state in which the rapidly heated ink layer adjacent to the heater element 23 instantaneously evaporates at the entire surface of the heater element 23, so that a boiling film (an air bubble 36) is grown. In this state, the surface temperature of the heater element 23 reaches in a range of 300°–400° C.

In FIG. 8, (*d*) shows a state in which the boiling film (the air bubble 36) is further grown, and the surface of the ink 28 on the heater element 23 rises above the rim of the opening 34 due to an impellent force generated by the growth of the air bubble 36.

In FIG. 8, (*e*) shows a state in which the air bubble is further grown and projected from the opening 34. Then, the air bubble 36 is continuously grown as shown by (f) and (g) in FIG. 8.

In FIG. 8, (*g*) shows a state in which the air bubble 36 is grown to a maximum. A time required for the air bubble 36 to grow to the maximum depends on the structure of the ink jet recording head, conditions of electrical pulses supplied to the heater element 23 and the like and is typically within a range 3–30 μsec after starting to supply the electrical pulse to the heater element 23. When the air bubble 36 is grown to the maximum, no current is supplied to the heater element 23 and the surface temperature of the heater element is about to fall. The air bubble 36 projected from the opening 34 is cooled from the outside of the ink 28 covering the air bubble 36 like a shell. The volume of the air bubble 36 reaches the maximum value at a time which is slightly delayed from the time when the electrical pulse is applied to the heater element 23.

In FIG. 8, (*h*) shows a state in which the air bubble 36 is cooled and start to contract. In this state, An ink column 37 is grown at the tip end part of the air bubble 36 and proceeds while maintaining a speed at which the air bubble 36 is projected from the opening 34.

In FIG. 8, (*i*) shows a state in which the air bubble 36 is further contracted and the ink column further proceeds. Thus, a constriction is formed in the ink column 37 at a rear end part.

In FIG. 8, (*j*) shows a state in which the air bubble 36 is further constructed and almost disappear. In this state, the ink column 37 is separated from the surface of the ink 28 and jetted, as a droplet 38, to a recording medium (not shown) at a speed obtained while the air bubble 36 is grown. The droplet 38 is jetted in a direction approximately perpendicular to the area of the opening 34. The speed at which the droplet 36 is jetted depends on an area of the opening 34, a distance between the heater element 23 and the opening 34, conditions of the electric pulse supplied to the heater element 23, and physical and chemical features of the ink 28, and is typically in a range 3–20 m/sec. In a case where the speed at which the ink is jetted from the opening 34 is relatively low (3–5 m/sec), the jetted ink is formed as a droplet. In a case where the speed at which the ink is jetted from the opening 34 is relatively high (6–10 m/sec), the jetted ink becomes long. In a case where the speed at which the ink jetted from the opening 34 further increases (15–20 m/sec), the jetted ink is separated into the ink column and several droplets. It is preferable that the ink is jetted from the opening 34 at a speed of more than 5 m/sec.

In FIG. 8, (*k*) shows a state in which the droplet 38 of the ink is further jetted an proceeds. In this state, the surface of the ink 28 at the opening 34 still ripples.

In FIG. 8, (*l*) shows a state in which the surface of the ink 28 at the opening 34 stops to ripple. This state (1) corresponds to the process of returning to the initial state shown in (a).

In the conventional process for ejecting the ink from the ink jet recording head, as shown in FIGS. 1 and 4, the diameter of the orifice of the nozzle 4 is small enough to keep the air bubble 3 in a space inside the nozzle 4. Thus, the bubble is generated, grown and disappear in the space inside the nozzle 4. On the other hand, the process, according to the present invention, for ejecting the ink from the ink jet recording head, the area of the opening 34 is greater than the heating area of the heater element 23 facing the opening 34. Thus, the air bubble 36 generated on the heater element 23 can be project from the opening 34 without large interference. Thus, the volume of a part, of the air bubble 36, projected from the opening 34 can be easily controlled in accordance with electrical energy supplied to the heater element 23. The greater the volume of the part, of the air bubble 36, projected from the opening 34, the greater the amount of ink in a droplet ejected from the opening 34. That is, the size of the droplet of the ink ejected from the opening 34 can be continuously controlled in accordance with the electrical energy supplied to the heater element 34. In addition, since the opening 34 is greater than the orifice of the nozzle in the conventional ink jet recording head, there is no problem in that the opening 34 is clogged with impurity included in the ink and refuse generated in an ink supplying system and the the flow path.

A detailed structure of the ink jet recording head is shown in FIG. 11. The substrate 22 is one of important parts of the ink jet recording head. The substrate 22 is made, for example, of glass, alumina ($Al_2O_3$), silicon or the like. A heat storage layer made, for example, of $SiO_2$ is formed on the substrate 22 of glass or alumina by a sputtering process. In a case where the substrate 22 is made of silicon, the heat storage layer 41 is formed on the substrate 22 by a thermal oxidation method. The thickness of the heat storage layer 41 is preferably in a range of 1–5 um. The heating element may be made of tantalum-$SiO_2$ mixture, tantalum nitride, nickel-chromium alloy, silver-palladium alloy, silicon semiconductor, or boride of metals such as hafnium, lanthanum, zirconium, titanium, tantalum, tungsten, molybdenum, niobium, chromium and vanadium. The boride of metals is suited for use as a material of the heater element 23. Of the materials tested, hafnium boride is most suitable of use as the material thereof. Next, zirconium boride, lanthanum boride, tantalum boride, vanadium boride and niobium boride are, in this order, suited for use as the material of the heater element 23. The heater element 23 made of the material as described above is formed on the heat storage layer 41 by a process such as an electron-beam process, an evaporation process or a sputtering process. The thickness of the heater element 23 depends on the area thereof, the material forming the heater element 23, the shape and size of the heating area of the heater element 23, power consumed and the like. The thickness of the heater element 23 is determined so that the amount of heat generated from the heater element 23 for a unit time becomes equal to a predetermined amount of heat. Thus, the thickness of the heater element 23 is normally in a range of 0.001–5 μm, and preferably in a range of 0.01–1 μm.

The control electrode 24 and the common electrode 25 may be made of a material normally used for electrode. That is, the control electrode 24 and the common electrode 25 are made of a material such as Al, Ag, Pt or Cu. The control electrode 24 and the common electrode 25 having predetermined size and shape are formed at a predetermined position to a predetermined thickness.

A protection layer 42 protects the heater element 23 from the ink without preventing the heat generated from the heater element 23 from being efficiently transmitted to the ink. The protection layer 42 is made of a material such as silicon oxide ($SiO_2$), silicon nitride, magnesium oxide, aluminum oxide, tantalum oxide and zirconium oxide. The protection layer 42 is formed on the heater element 23 by a process such as the electron-beam process, the evaporation process or the sputtering process. The thickness of the protection layer 42 is normally in a range of 0.01–10 μm, and preferably in a range of 0.1–5 μm. The optimum thickness of the protection layer 42 is in a range of 0.1–3 μm. The protection layer 42 is constructed by one or a plurality or layers. It is preferable that a metal layer made of Ta or the like be formed on the protection layer 42. The metal layer protects the heater element 23 from a cavitation which is generated when the air bubble is contracted and disappears. The thickness of the metal layer is preferably in a range of 0.05–1 μm.

A electrode protection layer 43 is made of a photosensitive polyimide resin such as polyimideisoindroquinazolinedion (PIQ, manufactured by HITACHI KASEI CO., LTD), polyimide resin (PYRALIN manufactured by DUPONT CO., LTD), cyclic polybutadiene (JSR-CBR, manufactured by NIPPON GOSEI GOMU CO., LTD) or Photoneece (manufactured by TORAY CO., LTD).

The spacer 32 is positioned between the substrate 22 and the plate 33 on which the openings 34 are formed to maintain the plate 33 in parallel to the substrate 22 at a predetermined distance. The ink chamber is formed between the substrate 22 and the plate 33. The distance between the substrate 22 and the plate 33 is one of important factors for constructing the ink jet recording head because the distance corresponds to the thickness of the ink layer supplied to the ink jet recording head.

The spacer 32 is made in accordance with, for example, the following manner.

A dry film photo-resist is laminated on the substrate 22. The photo-resist is exposed and developed by use of a photo mask having a masking pattern corresponding to the spacer 32. In a case where Ordyl SY325 manufactured by TOKYO OHKA CO., LTD is used as the dry film photo-resist, the spacer 32 having a thickness of 25 μm can be formed on the substrate 22. In a case where the dry film photo-resist having a thickness of 50 μm is utilized, the spacer 32 having a thickness of 50 μm can be formed. A liquid photo-resist having high viscosity may be also used for forming the spacer 32. The substrate 22 is coated with BMRS1000 (the liquid photo-resist) manufactured by TOKYO OHKA CO., LTD by a spin-coating process, so that a photo-resist layer having a thickness within a range of 10–40 μm can be formed on the substrate 22.

Before the dry film or liquid photo-resist layer completely cures, the plate 33 on which the openings 34 are formed is pressed on the photo-resist layer with heating. In this state, when the photo-resist layer completely cures, the spacer 32 made of the photo-resist layer is formed between the substrate 22 and the plate 33.

The spacer 32 can be also made of a resin film or a metal foil. In this case, the resin film or the metal foil is punched in a shape of the spacer 32. The spacer 32 can be also formed by an etching process.

The plate 33 on which the openings 34 are formed is made, for example, by a photo-fabrication method as shown in FIG. 12. Referring to FIG. 12, a photosensitive glass plate 46 is used as the plate 33, and the openings 34 are formed on the photosensitive glass plate 46. The photosensitive glass plate 46 is made of $SiO_2$—$Al_2O_3$—$Li_2O$ glass including $CeO_2$ and $Ag_2O$. The photosensitive glass 4 can be shaped into a fine pattern by applying an exposure process using ultraviolt rays, a thermal process, an etching process, a reexposure process, and a rethermal process.

In FIG. 12, (*a*) shows a state in which a pattern mask 47 is provided on the photosensitive glass plate 46, and ultraviolet rays (frequency: 280–350 nm) are projected onto the photosensitive glass plate 46 via the pattern mask 47. The following chemical reaction occurs in parts, of the photosensitive glass plate 46, onto which the ultraviolet rays are projected.

$$Ce^{2+}+Ag^{+}+h\nu \rightarrow Ce^{4+}+Ag^{++}$$

In FIG. 12, (*b*) shows a state in which, after the exposure process shown in (a), a first thermal process is applied to the photosensitive glass plate 46, so that metal colloid of Ag is generated on the photosensitive glass plate 46 (a developing process).

In FIG. 12, (*c*) shows a state in which, after the first thermal process shown in (b), a second thermal process is applied to the photosensitive glass plate 46, so that $Li_2O$—$SiO_2$ crystal is grown on a core of the metal colloid (a crystallizing process).

The $Li_2O$—$SiO_2$ crystal is very easily dissolved by an acid. In FIG. 12, (*d*) shows a state in which, after the second thermal process shown in (c), an etching process using a hydrofluoric acid 48 is applied to the photosensitive glass plate 46, so that the openings 34 are formed on the photosensitive glass plate 46.

In FIG. 12, (*e*) shows a state in which, after the etching process shown in (d), a reexposure process using the ultraviolet rays (frequency: 280–350 nm).

In FIG. 12, (*f*) shows a state in which, after the process shown in (e), a third thermal process is applied to the photosensitive glass plate 46, so that $Li_2O.SiO_2$ crystal is grown in the photosensitive glass plate 46. In this state, the photosensitive glass plate 46 is crystallized so that a crystallized glass plate 49 on which the openings 34 is formed. The crystallized glass plate 49 can be resistive to an acid, heat and ultraviolet rays.

The plate 33 on which the openings 34 are formed can by made by a photo-electroforming method, as shown in FIG. 13.

In FIG. 13, (*a*) shows a state in which a preprocessing is applied to a stainless steel base 51, so that the polished surface of the stainless steel base 51 is roughly etched by an acid 52.

In FIG. 13, (*b*) shows a state in which a liquid photoresist 53 is made to flow on the surface of the stainless steel base 51 so that the surface of the stainless steel base 51 is coated with the liquid photoresist 53. By other process such as a dipping method or a spin-coating method, also, the surface of the stainless steel base 51 can be coated with the liquid photoresist 53.

In FIG. 13, (*c*) shows a state in which an exposure process is applied to the stainless steel base 51. After solvent included in the photoresist 53 is dried by a baking process, ultraviolet rays emitted from a light source 55 is projected onto the photoresist 53 on the stainless steel base 51 via an emulsion mask 54 having a predetermined pattern.

In FIG. 13, (*d*) shows a state in which, after the exposure process shown in (c), a developing process is applied to the stain less steel base 51. In a case where the photoresist 53 is a negative type, parts, of the photoresist 53, onto which the ultraviolet is projected are cured, and other parts are removed from the stainless steel base 51 by a developer. As a result, the photoresist 53 remains in a predetermined pattern on the stainless steel base 51. After that, the photoresist pattern formed on the stainless steel base 51 is cured by a post-baking process.

In FIG. 13, (*e*) shows a state in which an electroforming process is applied to the stainless steel base 51. A Ni plate 56 used as an anode electrode and the stainless steel base 51 used as a cathode electrode are set in a plating liquid 57 and an electric current is supplied to the Ni plate 56 and the stainless steel base 51. In this state, an Ni-layer 58 is deposited on parts of stainless steel, but is not deposited on the photoresist 53.

In FIG. 13, (*f*) shows a state in which the Ni-layer 58 is separated from the stainless steel base 51, so that the plate 33 formed of the Ni-layer 58 is obtained, the plate 33 having the openings 34.

The plate 33 on which the openings 34 are formed can be also formed by a photo-etching method, as shown in FIG. 14.

In FIG. 14, (*a*) shows a state in which a preprocessing is applied to a stainless steel foil 61, so that the polished both surfaces of the stainless steel foil 61 is roughly etched by an acid 62.

In FIG. 14, (*b*) shows a state in which a liquid photoresist 63 is made to flow on both the surfaces of the stainless foil 61, so that both the surface of the stainless steel foil 61 are coated with the liquid photoresist 63. By another process such as a dipping method, the stainless steel foil 61 can be coated with the liquid photoresist 63.

In FIG. 14, (*c*) shows a state in which, after the process shown in (b), an exposure process is applied to the stainless steel foil 61. After solvent included in the photoresist 63 is dried by a pre-baking process, emulsion masks 64 each having a predetermined pattern are set on the photoresist layers 63 formed on both the surface of the stainless steel foil 61, and then ultraviolt rays emitted from light sources 65 are projected onto the photoresist layers 63 via the emulsion masks 64.

In FIG. 14, (*d*) shows a state in which a developing process is applied to the photoresist layers 63. In a case where the photoresist is a positive type, parts, of the photoresist layer 63, onto which the ultraviolet rays are projected are cured, but other parts are removed from the stainless steel foil 61 by a developer. As a result, the photoresist layers 63 each having a predetermined pattern remain on both the surfaces of the stainless steel foil 61. After that, the photoresist layers 63 each having the predetermined pattern are cured by a post-baking process.

In FIG. 14, (*e*) shows a state in which an etching process is applied to the stainless steel foil 61. Parts, of the stainless steel foil 61, which are exposed from the photoresist layers 63 are etched by etchant ejected from spray-nozzles 67. As a result, these parts of the stainless steel foil 61 are off so that openings are formed.

In FIG. 14, (*f*) shows a state in which the stainless steel foil 61 which has been etched as shown in (e) is soaked in a separating agent 68. The photoresist layers 63 are removed from the stainless steel foil 61, so that the plate 33 formed of the stainless steel foil 61 is obtained, the plate 33 having the openings 34.

The plate 33 on which the openings 34 are formed can be also made by a resin molding process.

In this case, the plate 33 is made of a material having a superior ink resistivity, such as polysulphone, polyethersulphone, polyphenylene oxide or polypropylene. The plate 33 is formed by an injection molding machine having an injection pressure greater than 2000 kg/cm$^2$ under a condition in which a cylinder temperature is equal to or greater than 400° C.

Figure 15:
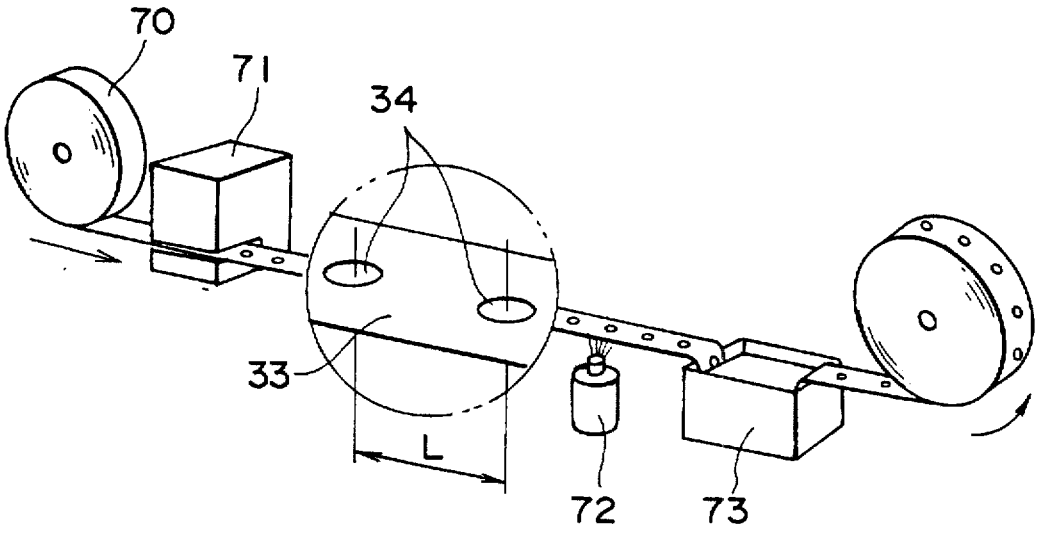
Figure 16:
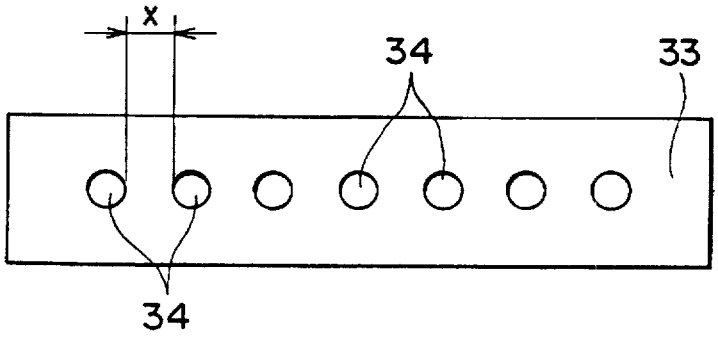
FIG. 16 is a diagram illustrating the plate on which the openings are formed.

The plate 33 on which the openings 34 are formed can be also made by a punching process, as shown in FIG. 15.

Referring to FIG. 15, a stainless steel foil 70 having a thickness with in a range of 50–100 um is wound on a roll. The stainless steel foil 70 is continuously supplied from the roll to a punching machine 71. The punching machine 7 successively punches the stainless steel foil 70 so that the openings 34 are successively formed on the stainless steel foil 70. After forming the openings 34, burr is removed from each of openings 34 by trimming machine 72. The stainless steel foil 70 is cleaned by washer 73. The stainless steel foil 70 on which the openings are formed by the above punching process is cut in a predetermined length corresponding to the size of the ink jet recording head.

The plate 33 on which the openings are formed can be also made by an eximer laser process.

In this eximer laser process, the plate 33 on which the openings are formed is made of a material such as polysulphone, polyethersulphone, polyphenylene oxide or polypropylene. Ultraviolet rays emitted from an eximer laser unit are projected onto a plastic plate (e.g. 5 mm×20 mm×0.05 mm) via a mechanical mask having a predetermined pattern corresponding to an arrangement of the openings 34. Parts, of the plastic plate, onto which the ultraviolet rays are projected are evaporated and removed, so that the openings 34 are formed on the plastic plate.

The size of each opening, states in which droplets of ink are ejected from the ink jet recording head and the like will be examined bellow.

Table-1 indicates states of the growth of the air bubble corresponding to various sizes of each opening. The states of the growth of the air bubble indicated in Table-1 were obtained in the ink jet recording head under the following conditions. The size of each heater element 23 was 100 μm×100 μm, a resistance of each heater element 23 was 122Ω. The plate 33 was made from a photosensitive glass plate having a thickness of 50 μm, in the manner as shown in FIG. 12. The processes after that shown (d) in FIG. 12 was omitted. That is, before the photosensitive plate 46 was crystallized, the process was discontinued. As a result, a transparent plate 33 on which the openings are formed was obtained. Thus, in the ink jet recording head using the transparent plate 33, the air bubble generated in the ink jet recording head could be seen. A transparent vehicle was substituted for the ink 28 used for "Desk Jet" manufactured by Hewlett-Packard Company. The matter of the transparent vehicle has the same properties as the ink 28 of Hewlett-Packard Company. The transparent plate 33 was connected to a spacer 32 formed of a dry film photoresist (a thickness of 25 μm) by the photolithography technique. A pulse signal having a pulse width of 6 μsec and a frequency of 1 kHz were supplied to the heater element 23. The behavior of the air bubble 36 was observed by using a stroboscope operating in synchronism with the pulse signal supplied to the heater element 23.

TABLE 1

| | d | DRIVING VOLTAGE | | | | |
|---|---|---|---|---|---|---|
| No. | (μm) | 28 | 30 | 32 | 34 | NOTE |
| 1 | 30 | A | A | A | A | same behavior |
| 2 | 55 | A | A | A | A | same behavior |
| 3 | 70 | A | A | A | A | same behavior |
| 4 | 115 | A | B | C | D | special behavior |
| 5 | 170 | A | B | C | D | special behavior |
| 6 | 250 | A | B | C | D | special behavior |
| 7 | 330 | A | B | C | D | special behavior |

d: A diameter of the opening
State A: A state in which The air bubble 36 is generated, grown and disappeared under the opening of the plate 33
State B: A state in which the air bubble 36 is slightly projected from the riin of the opening 23
State C: A state in which the air bubble 36 is further projected from the rim of the opening 23
State D: A state in which the air bubble 36 is further projected from the rim of the opening 23 and extends forward The following Table-2 indicate states of the growth of the air bubble corresponding to various sizes of each opening. The states of the growth of the air bubble indicated in Table-2 were obtained in the ink jet recording head under the following conditions. The size of the heater element 23 decreased to 60 μm×60 μm. The resistance of the heater element 23 was changed to 70Ω. The pulse signal having a pulse width of 5 μsec and a frequency of 1.3 kHz. Other conditions are the same as those in the case indicated in Table-1.

TABLE 2

| | d | DRIVING VOLTAGE | | | | |
|---|---|---|---|---|---|---|
| No. | (μm) | 21 | 23 | 25 | 27 | NOTE |
| 1 | 30 | A | A | A | A | same behavior |
| 2 | 55 | A | A | A | A | same behavior |
| 3 | 70 | A | B | C | D | special behavior |
| 4 | 115 | A | B | C | D | special behavior |
| 5 | 170 | A | B | C | D | special behavior |
| 6 | 250 | A | B | C | D | special behavior |
| 7 | 330 | A | B | C | D | special behavior |

d : A diameter of the opening
State A: A state in which the air bubble 36 is generated, grown and disappeared under the opening of the plate 33
State B: A state in which the air bubble 36 is slightly projected from the rim of the opening 23
State C: A state in which the air bubble 36 is further projected from the rim of the opening 23
State D: A state in which the air bubble 36 is further projected from the rim of the opening 23 and extends forward According to results indicated in Table-1 and Table-2, in a case where the size of the opening is small, an air bubble is generated, grown, contracted and disappeared in the ink under the opening in the same manner as the conventional case. Thus, even if the driving voltage supplied to the heat element varies, the size of the air bubble generated in the ink does not vary.

On the other hand, in a case where the area of the opening 34 is greater than the area of the heater element 23, a special behavior of the air bubble different from that of the conventional case is shown. That is, when the driving voltage is low, the air bubble generated in the ink is small, and the air bubble is generated and disappeared under the opening 34. When the driving voltage increases, the air bubble is projected from the rim of the opening 34, and grown in a direction perpendicular to the opening 34. The size of the air bubble depends on a value of the driving voltage. That is, the amount of a part, of the air bubble 36, projected from the rim of the opening 34 is controlled based on the driving voltage supplied to the heater element 23.

Next, a distance between adjacent openings will be examined below.

Table-3 indicates observation results of behaviors of droplets 38 ejected from the ink jet recording head when adjacent heater elements are simultaneously driven. Various types of plates having the openings which were made by the various processes described above were used in the ink jet recording head one by one. A distance (x) between adjacent openings 34 on each plate 33 shown in FIG. 16 were varied. The thickness of the plate 33 having the openings 34 was 50 μm, and the diameter of each of the openings 34 was 250 μm. The adjacent heater elements 23 were driven in the same conditions as the heater element in the case of Table-1.

TABLE 3

| | x | | TYPE OF PLATE | | | |
|---|---|---|---|---|---|---|
| No. | (μm) | | A | B | C | D |
| 1 | 10 | FORMING | x | x | x | x |
| | | FLYABILITY | — | — | — | — |
| 2 | 15 | FORMING | ○ | x | x | ○ |
| | | FLYABILITY | x | — | — | x |
| 3 | 20 | FORMING | ○ | ○ | ○ | ○ |

TABLE 3-continued

| No. | x (μm) | | TYPE OF PLATE A | B | C | D |
|---|---|---|---|---|---|---|
| | | FLYABILITY | x | x | x | x |
| 4 | 27 | FORMING | ○ | ○ | ○ | ○ |
| | | FLYABILITY | ○ | ○ | ○ | ○ |
| 5 | 35 | FORMING | ○ | ○ | ○ | ○ |
| | | FLYABILITY | ○ | ○ | ○ | ○ |
| 6 | 50 | FORMING | ○ | ○ | ○ | ○ |
| | | FLYABILITY | ○ | ○ | ○ | ○ |
| 7 | 90 | FORMING | ○ | ○ | ○ | ○ |
| | | FLYABILITY | ○ | ○ | ○ | ○ |
| 8 | 150 | FORMING | ○ | ○ | ○ | ○ |
| | | FLYABILITY | ○ | ○ | ○ | ○ |
| 9 | 250 | FORMING | ○ | ○ | ○ | ○ |
| | | FLYABILITY | ○ | ○ | ○ | ○ |
| 10 | 500 | FORMING | ○ | ○ | ○ | ○ |
| | | FLYABILITY | ○ | ○ | ○ | ○ |

Type-A: This type of plate is a plate using a stainless steel plate and formed by the photo-etching process.
Type-B: This type of plate is a plate formed of polysulphone by the molding process.
Type-C: This type of plate is a plate formed of a stainless steel plate on which the openings are formed by the punching process.
Type-D: This type of plate is a plate formed of polysulphone by the eximer laser method.

Figure 17:
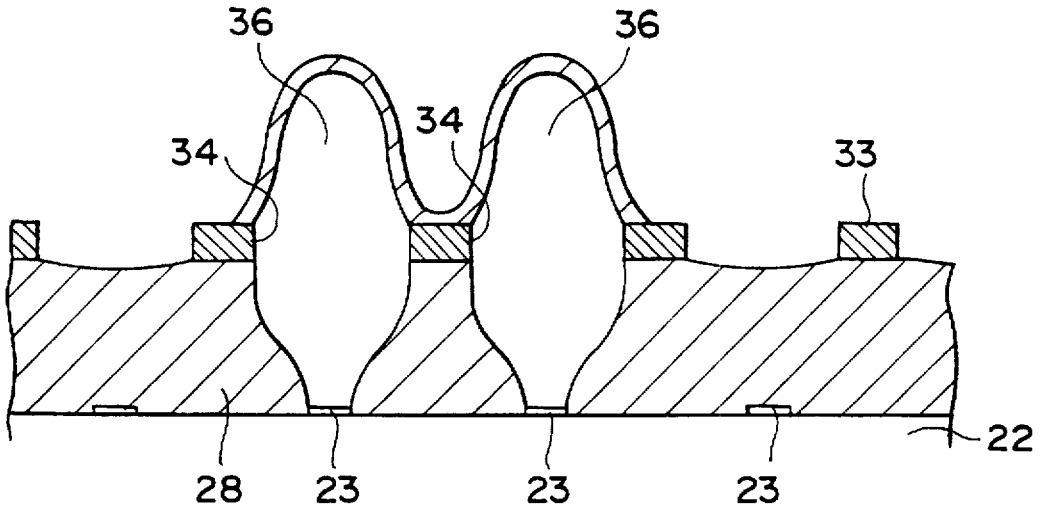
FIGS. 17 and 18 are diagrams illustrating air bubbles projected from the openings.
Figure 18:
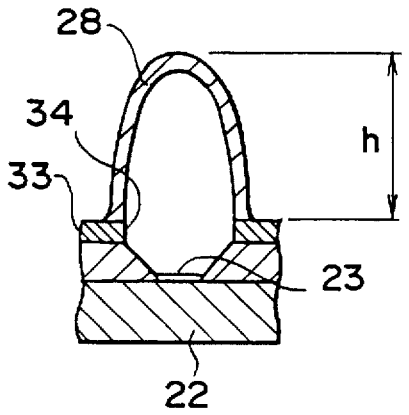

In Table-3, a judgment symbol "○" in each "FORMING" row represents that fine openings 34 were formed on the plate 33, a judgment symbol "x" in each "FORMING" row represents that no fine openings 34 were formed on the plate 33 because the distance between adjacent openings is too short. Further, in Table-3, a judgment symbol "○" in each "FLYABILITY" row represents that air bubbles 36 were formed in good shape on the heater elements adjacent to each other without affecting each other. That is, in this case, droplets of ink were ejected in good condition from adjacent openings 34. A judgment symbol "x" in each "FLYABILITY" row represents that air bubbles 36 projected from adjacent openings affected each other as shown in FIG. 17. That is, in this case, droplets of ink ejected from the adjacent openings 34 did not fly straight.

According to results indicated in Table-3, to prevent air bubbles 36 projected from adjacent openings from affecting each other, that the distance (x) between the adjacent openings must be equal to or greater than one tenth of the diameter of each of the openings 34. But, if the distance (x) between the adjacent openings is too large, dots can not be printed at a high rate in a line. Thus, it is preferable that the distance (x) between the adjacent openings be equal or less than ten times of the diameter of each of the openings 34.

In a case where the thickness of the plate was changed to various value, observation results of behaviors of droplets 38 ejected from the ink jet recording head were obtained as shown in Table-4. In this case, the diameter of the opening is 250 μm and the heater element 23 was driven under the same conditions as that in the case of Table-1.

TABLE 4

| No. | THICKNESS (μm) | | TYPE OF PLATE A | B | C | D |
|---|---|---|---|---|---|---|
| 1 | 20 | FORMING | ○ | x | x | ○ |
| | | FLYABILITY | ○ | — | — | ○ |
| 2 | 30 | FORMING | ○ | x | ○ | ○ |
| | | FLYABILITY | ○ | — | ○ | ○ |
| 3 | 50 | FORMING | ○ | ○ | ○ | ○ |

TABLE 4-continued

| No. | THICKNESS (μm) | | TYPE OF PLATE A | B | C | D |
|---|---|---|---|---|---|---|
| | | FLYABILITY | ○ | ○ | ○ | ○ |
| 4 | 70 | FORMING | ○ | ○ | ○ | ○ |
| | | FLYABILITY | ○ | ○ | ○ | ○ |
| 5 | 100 | FORMING | ○ | ○ | ○ | ○ |
| | | FLYABILITY | ○ | ○ | ○ | ○ |
| 6 | 150 | FORMING | ○ | ○ | ○ | ○ |
| | | FLYABILITY | Δ | Δ | Δ | Δ |
| 7 | 220 | FORMING | ○ | ○ | ○ | ○ |
| | | FLYABILITY | Δ | Δ | Δ | Δ |
| 8 | 300 | FORMING | ○ | ○ | ○ | ○ |
| | | FLYABILITY | — | x | x | — |

Type-A: This type of plate is a plate using a stainless steel plate and formed by the photo-etching process.
Type-B: This type of plate is a plate formed of polysulphone by the molding process.
Type-C: This type of plate is a plate formed of a stainless steel plate on which the openings are formed by the punching process.
Type-D: This type of plate is a plate formed of polysulphone by the eximer laser method.

In Table-4, a judgment symbol "○" in every "FORMING" row represents that fine openings 34 were formed on the plate 33, a judgment symbol "x" in every "FORMING" row represents that no fine openings 34 were formed on the plate 33. Further, in Table-4, a judgment symbol "○" in each "FLYABILITY" row represents that droplets of ink were ejected from the opening 34 at a speed equal to or greater than 6 m/sec, a judgment symbol "Δ" in each "FLYABILITY" row represents that droplets of ink were ejected from the opening 34 at a speed within a range of 3–5 m/sec, and a judgment symbol "x" in each "FLYABILITY" row represents that no droplet of ink was ejected from the opening 34.

According to results indicated in Table-4, the thickness of the plate 33 at a point close to each opening is needed to be less than a square root of the area of each opening 34. It is preferable that the thickness of the plate 33 at a point close to each opening be less than a half of a square root of the area of each opening 34.

It is necessary for the ink 28 to have properties which are generally required for the ink used in the ink jet recording head. For example, the ink having the properties disclosed in Japanese Laid-Open Application No. 1-184148 is suited for the ink in the ink jet recording head according to the present invention.

The following experiments of printing dot images were carried out.

Experiment 1

Experiment 1, a dot image was recorded on a recording sheet under the following conditions.

SIZE OF HEATER ELEMENT 23: 100 μm×100 μm

DIAMETER OF OPENING 34: ϕ250 μm

THICKNESS OF PLATE 33: 70 μm

DISTANCE BETWEEN SUBSTRATE 22 AND PLATE 33: 25 μm

NUMBER OF HEATER ELEMENTS 23 (OPENINGS 34)

IN UNIT LENGTH: 2.5/mm

TOTAL NUMBER OF HEATER ELEMENTS (OPENINGS 34): 64

RESISTANCE OF HEATER ELEMENT 23: 120Ω

DRIVING VOLTAGE: 30 V

PULSE WIDTH: 6 μsec.

CONTINUOUS DRIVING FREQUENCY: 1.8 kHz

INK: INK USED IN DESK JET (Hewlett Packard COMP.)

When the experiment of the printing was carried out under the above conditions, a fine dot image was formed on a matted coat sheet NM (manufactured by MITSUBISHI CO., LTD). The mean value of the diameters of ink dots adhered on the sheet was 225 μm (the total number of sampled dots is ten). When the heater element 23 was continuously driven at 1.8 kHz, droplets of the ink was ejected from the opening at 14.4 m/sec.

Experiment 2

In Experiment 2, a dot image was recorded on a recording sheet under the following conditions.

SIZE OF HEATER ELEMENT 23: 60 μm×60 μm

DIAMETER OF OPENING 34: ϕ150 μm

THICKNESS OF PLATE 33: 42 μm

DISTANCE BETWEEN SUBSTRATE 22 AND PLATE 33: 20 μm

NUMBER OF HEATER ELEMENTS 23 (OPENINGS 34)

IN UNIT LENGTH: 4/mm

TOTAL NUMBER OF HEATER ELEMENTS (OPENINGS 34): 64

RESISTANCE OF HEATER ELEMENT 23: 71Ω

DRIVING VOLTAGE: 23 V

PULSE WIDTH: 5 μsec.

CONTINUOUS DRIVING FREQUENCY: 3.2 kHz

INK: INK USED IN DESK JET (Hewlett Packard COMP.)

When the experiment of the printing was carried out under the above conditions, a fine dot image was formed on the matted coat sheet NM (manufactured by MITSUBISHI CO., LTD). The mean value of the diameters of ink dots adhered on the sheet was 160 μm (the total number of sampled dots is ten). When the heater element 23 was continuously driven at 3.2 kHz, droplets of the ink was ejected from the opening at 15.6 m/sec.

Experiment 3

Experiment 3, the ink jet recording head having the same construction as that used in Experiment 1 was used, and the driving voltage, the pulse width and/or the number of pulses were varied. Results of Experiment 3 is indicated in Table-5.

TABLE 5

| No. | $V_o$ (V) | $P_w$ (us) | N | h | D (μm) |
|---|---|---|---|---|---|
| 1 | 28 | 6 | 1 | 0 | 170 |
| 2 | 29 | 6 | 1 | 60 | 206 |
| 3 | 30 | 6 | 1 | 100 | 225 |
| 4 | 31 | 6 | 1 | 150 | 241 |
| 5 | 32 | 6 | 1 | 275 | 270 |
| 6 | 33 | 6 | 1 | 360 | 315 |
| 7 | 34 | 6 | 1 | 420 | 366 |
| 8 | 30 | 5 | 1 | 0 | 168 |
| 9 | 30 | 6 | 1 | 100 | 226 |
| 10 | 30 | 7 | 1 | 300 | 294 |
| 11 | 30 | 8 | 1 | 430 | 375 |
| 12 | 30 | 3 | 2 | 110 | 240 |
| 13 | 30 | 3 | 3 | 435 | 378 |
| 14 | 30 | 2 | 2 | 0 | 170 |

TABLE 5-continued

| No. | $V_o$ (V) | $P_w$ (us) | N | h | D (μm) |
|---|---|---|---|---|---|
| 15 | 30 | 2 | 3 | 110 | 230 |
| 16 | 30 | 2 | 4 | 440 | 380 |
| 17 | 30 | 2 | 5 | 450 | 386 |

$V_o$: driving voltage
$P_w$: pulse width of driving pulse
h: a height of maximuin size of air bubble from the rim of the opening (see FIG. 18)
D: a diameter of each dot
N: the number of pulses supplied to the heater element in 1 μsec.

According to results indicated in Table-5, due to changing driving energy, the size of the air bubble 36 varies and is projected from the rim of the opening 34. The size of each dot in a dot image varies in accordance with changing the size of the air bubble.

When the driving voltage was changed from 28 v (case 1 in Table-5) to 29 v (case 2 in Table-5) by 0.2 v, the results shown in Table-6 were obtained.

TABLE 6

| $V_o$ (V) | h (μm) | $v_j$ (m/sec) | D (μm) |
|---|---|---|---|
| 28.0 | 0 | 2.9 | 170 |
| 28.2 | 10 | 3.2 | 171 |
| 28.4 | 20 | 4.5 | 176 |
| 28.6 | 24 | 4.9 | 180 |
| 28.8 | 42 | 7.7 | 195 |
| 29.0 | 60 | 10.1 | 206 |

$V_o$ : driving voltage
h: a height of maximum size of air bubble from the rim of the opening
D: a diameter of each dot
$v_j$: jetting velocity of droplet According to results indicated in Table-6, in a case where the height of the maximum size of the air bubble was less than the distance between the substrate 22 and the plate 33 (25 μm), the jetting velocity of the droplet of the ink was relatively low and a state of jetting the droplet was slightly unstable.

A description will now be given, with reference to FIGS. 19 through 21, of a second embodiment of the present invention.

Figure 19:
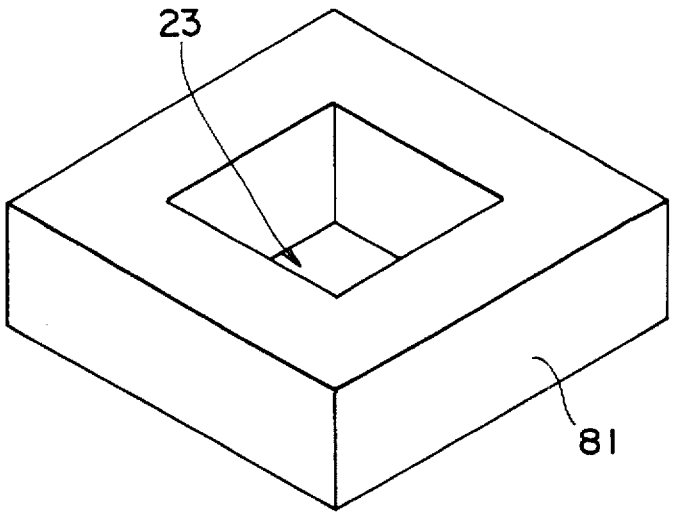
FIGS. 19, 20 and 21 are diagrams illustrating an ink jet recording head according to a second embodiment of the present invention.
Figure 20:
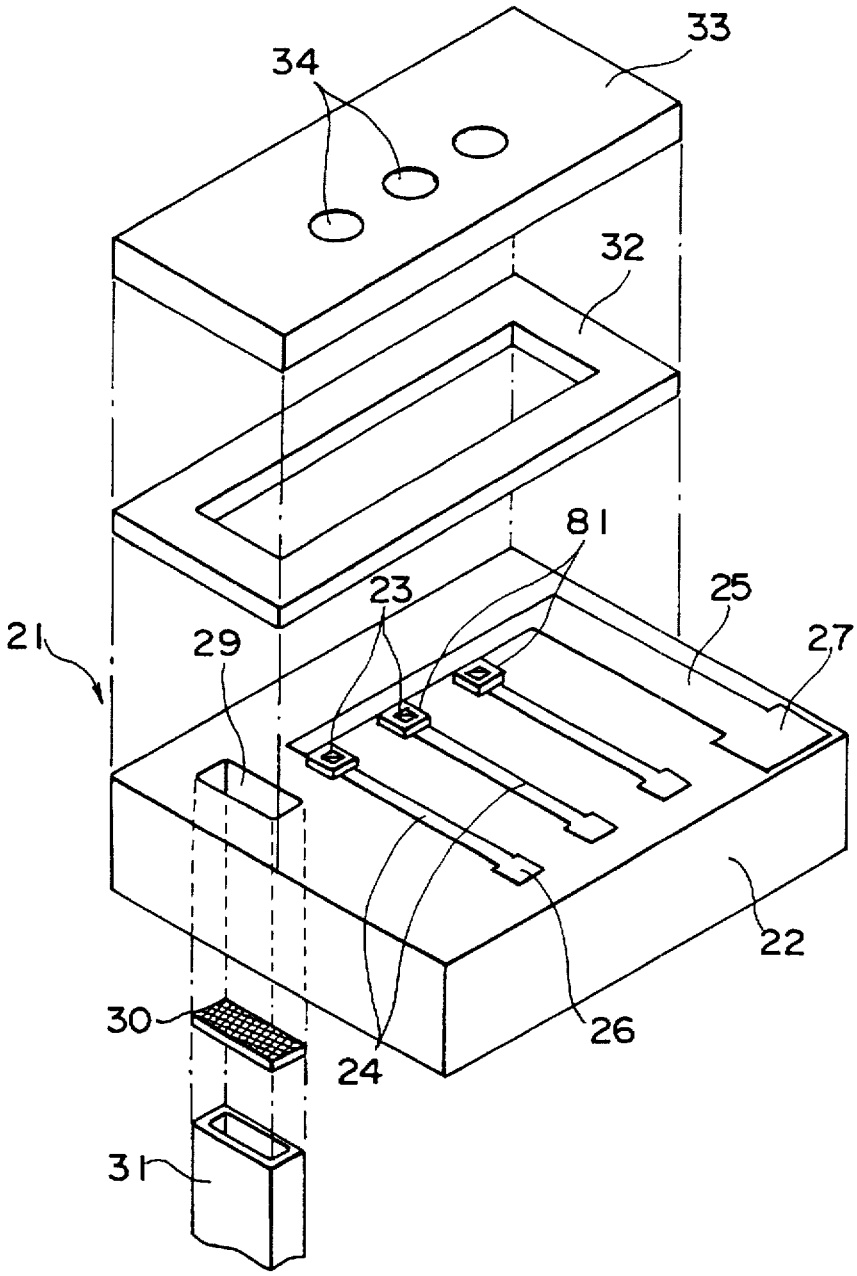
Figure 21:
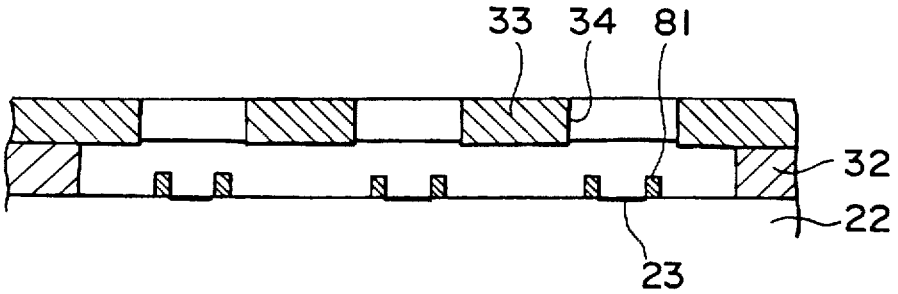

In the second embodiment, as shown in FIGS. 20 and 21, each of the heater elements 23 is surrounded by a pressure dispersion stopping block 81 having a square ring shape as shown in FIG. 19. The pressure dispersion stopping block 81 prevents pressure generated by the air bubble 36 on each of the heater elements 23 from dispersing in directions parallel to the surface of each of the heater elements 23. Due to the pressure dispersion stopping block 81, the air bubble can be efficiently grown in a direction perpendicular to the surface of each of the heater elements 23. The pressure dispersion stopping block 81 may be made, for example, by a photolithography process using a dry film photoresist or a liquid photoresist. The height of the pressure dispersion stopping block 81 is less than that of the spacer 32, as shown in FIG. 21, so that the ink is supplied to a space above each of the heater elements 23 via an opening of the pressure dispersion stopping block 81.

Figure 22:
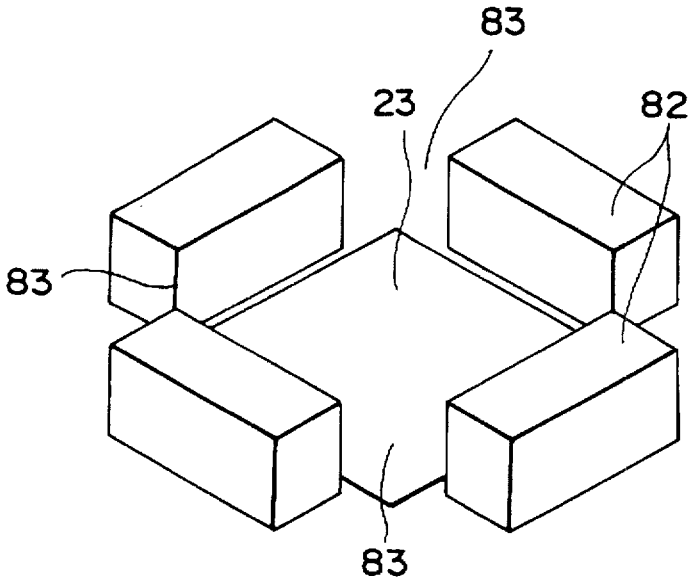
FIGS. 22 and 23 are diagrams illustrating walls surrounding each of the heater element.

FIG. 22 shows a modification of the pressure dispersion stopping block.

Figure 23:
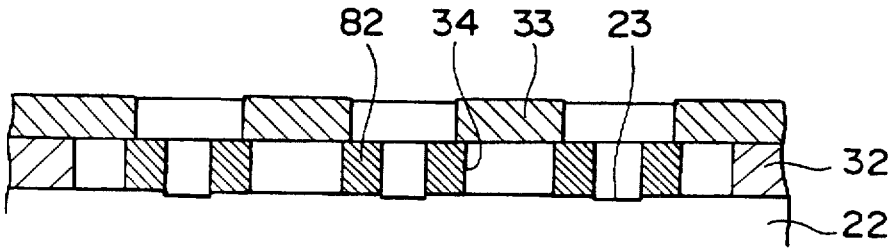

In this modification, the pressure dispersion stopping block is formed of four blocks 82 separated from each other. The blocks 82 surround each of the heater elements 23 at four sides thereof. Since the blocks 82 are separated from each other, an intake path 83 connecting a space on each of the heater elements 23 to the outside of the dispersion stopping block (formed of the blocks 82) are formed between adjacent blocks 82. Thus, the height of each of the blocks 82 is equal to that of the spacer 32 as shown in FIG. 23, and the ink is supplied to the space on each of the heater elements 23 via each intake path 83. Thus, the blocks 83 and the spacer 32 may be simultaneously formed on the substrate 22.

A driving experiment of the ink jet recording head utilizing the pressure dispersion stopping block is described below.

The pressure dispersion stopping block 82 having the four blocks 83 shown in FIG. 22 was simultaneously formed on the substrate 22 when forming the spacer 32 by the photolithography process. The pressure dispersion stopping block 82 was arranged so as to closely surrounding each of the heater elements 23 and had a size of 70 μm×50 μm and the height of 25 μm. Other structures of the ink jet recording head were the same as those of the ink jet recording head used in Experiment 1. When the ink jet recording head was driven under the same conditions as that driven in Experiment 1, a fine dot image was formed on the sheet. The average of diameters of dots was equal to 256 μm. When the ink jet recording head was continuously driven at a frequency of 1.8 kHz, the droplets were jetted at 17.8 m/sec. Thus, it was confirmed that the pressure generated by the air bubble 36 was efficiently transmitted to the ink 28.

A description will now be given of a third embodiment of the present invention with reference to FIG. 24.

Since each opening 34 formed on the plate 33 of the ink jet recording head is relatively large, the present invention has a disadvantage in that a large number of openings can not be arranged in a line. Thus, it is difficult to obtain a dot image in which dots are arranged at a high density. The third embodiment is provided to eliminate this disadvantage.

Figure 24:
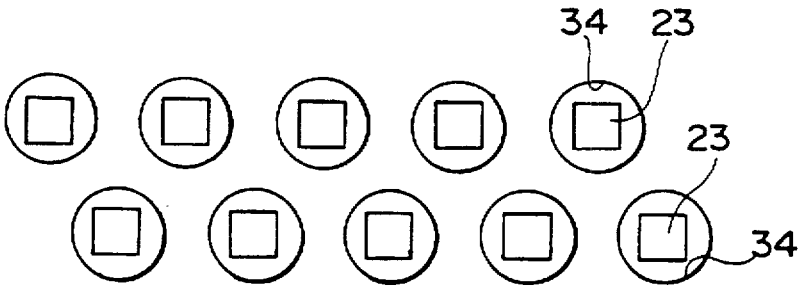
FIG. 24 is a plan view of a plate provided in an ink jet recording head according to a third embodiment of the present invention.

In the third embodiment, the openings 34 facing the heater elements 23 are arranged so as to zigzag along two lines, as shown in FIG. 24. In a case where the ink jet recording head having the structure shown in FIG. 24 records a dot image, each dot line in the dot image is formed by two lines in which the openings 34 facing the heater elements 23 are arranged.

The openings 34 facing the heater elements 23 may be arranged so as to zigzag along a plurality of lines more than two.

A description will now be given, with reference to FIGS. 25, 26, 27, 28A and 28B, of a fourth embodiment.

In the fourth embodiment, a structure of a part, of the plate 33, adjacent to each opening is improved so that air bubbles projected from adjacent openings are prevented from affecting each other as shown in FIG. 17.

Figure 25:
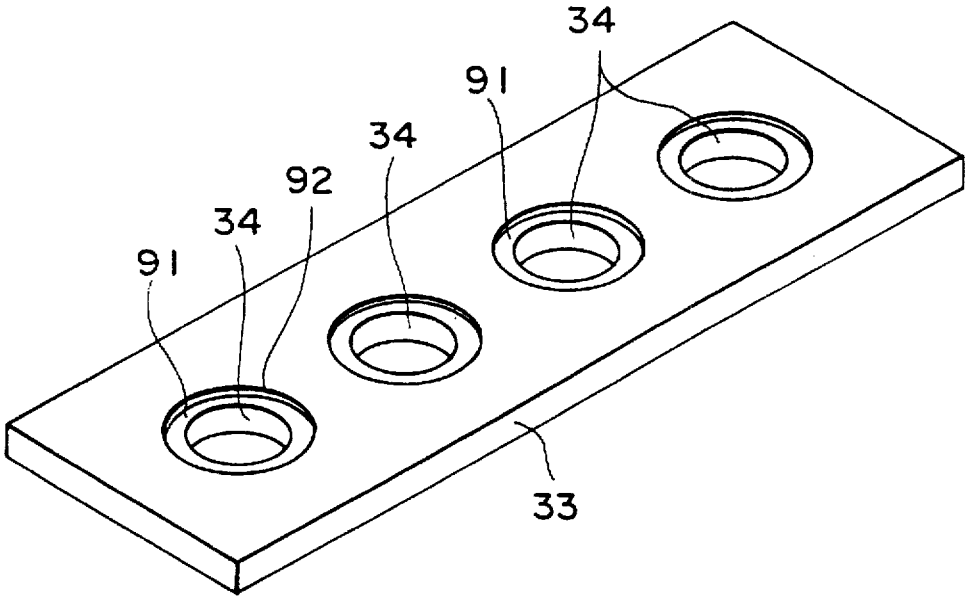
FIGS. 25 and 26 are diagrams illustrating a plate provided in an ink jet recording head according to a fourth embodiment of the present invention.
Figure 26:
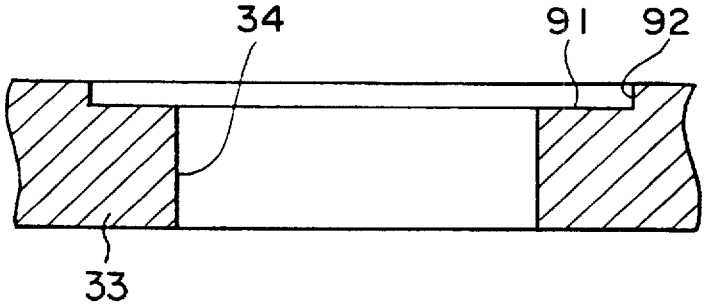
Figure 27:
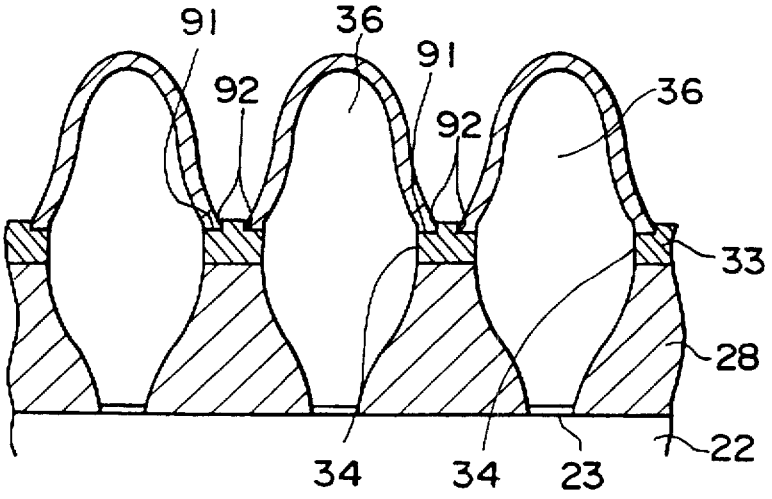
FIG. 27 is a diagram illustrating air bubbles projected from the openings on the plate shown in FIGS. 25 and 26.

Referring to FIGS. 25 and 26, a ring-shaped concave portion 91 is formed around each of the openings 34 on the plate 33 so that each of the openings 34 is surrounded by a wall 92 on the plate 33. According to the structure of the plate 33, when the air bubble 36 is projected from the opening 34, the air bubble 36 is prevented, by the wall 92, from expanding in directions parallel to the surface of the plate 33, as shown in FIG. 27. Thus, the air bubbles 36 projected from adjacent openings 34 are prevented from affecting each other.

The plate 33 having the structure shown in FIGS. 25 and 26 may be made by the photoetching process as shown in FIG. 14. In this case, before a step shown by (a) in FIG. 14, the concave portion 91 be formed on a surface of the stainless steel foil 61 by the photolithography etching process, or after the last step shown by (f) in FIG. 14, the concave portion 91 around each opening on the plate 33 by the photolithography etching process.

The plate 33 having the structure shown in FIGS. 25 and 26 may be also made by the photo-electroforming method as shown in FIG. 13.

Figure 28A:
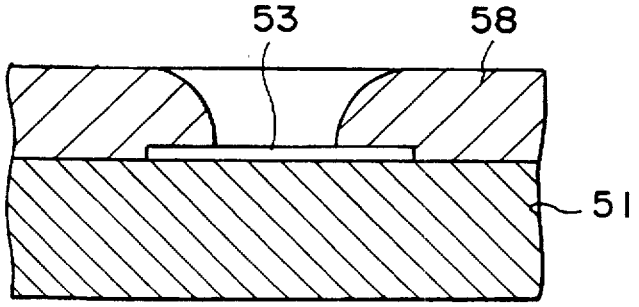
FIGS. 28A and 28B are diagrams illustrating a process for forming the plate shown in FIGS. 25 and 26.
Figure 28B:
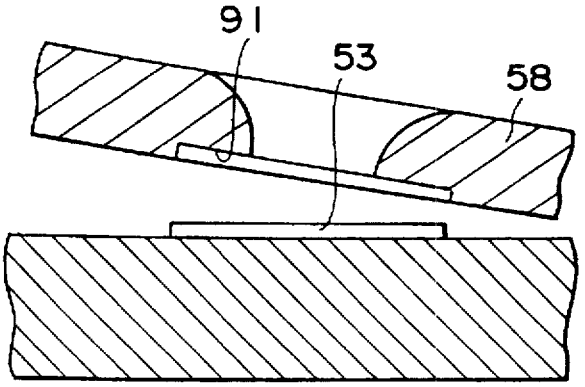

In this case, the state shown by (e) in FIG. 13 and the state shown by (f) in FIG. 13 respectively correspond to states shown in FIGS. 28A and 28B. The electroforming process is continuously carried out in the state shown by (e) in FIG. 13, so that the Ni-layer 58 deposited on the stainless steel base 51 further extends to a space on the photoresist 53 as shown in FIG. 28A. Then, the Ni-layer 58 deposited on the stainless steel base 51 is separated from the stainless steel base 51, so that the concave portion 91 is formed at an area covering the photoresist 53 on the Ni-layer 58 as shown in FIG. 28B. The depth of the concave portion 91 can be accurately controlled based on the thickness of the photoresist 53.

Figure 29:
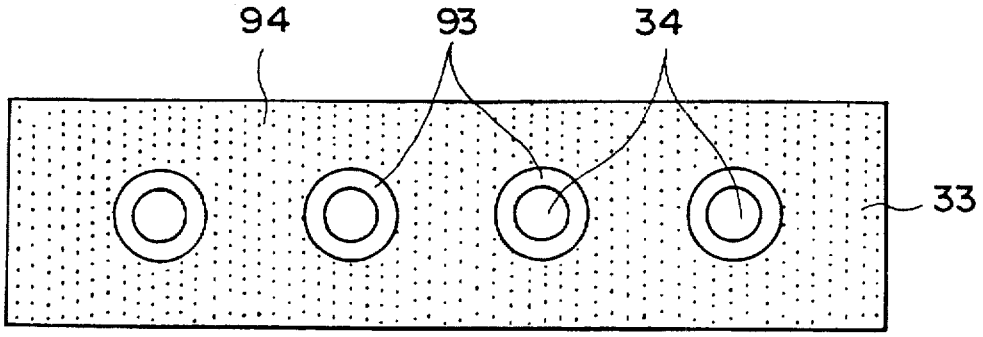
FIG. 29 is a plan view illustrating a plate provided in an ink jet recording head according to a fifth embodiment of the present invention.

A description will now be given of a fifth embodiment of the present invention with reference to FIG. 29. In the fifth embodiment, the surface of the plate 33 is coated with a material having a high ink repellence property except a region 93 around each of the openings 34. That is, a region 94 shown as a dotted region in FIG. 29 is coated with the material. In a case where water-based ink is used, the surface of the plate 33 is coated with a material having a high water repellency (a water repellent finish), such as a silicon resin dissolved by toluene. In a case where oil based ink is used, the surface of the plate 33 is coated with a material having a high oil repellency (an oil repellent finish), such as gum arabic dissolved by phosphate aqueous solution.

The region 94 on the plate 33 is coated with the material as follows. That is, each of the openings 34 and the region 93 around each of the openings 34 are covered by a mask, and the plate 33 is dipped in the solution formed of the material with which the plate 33 should be coated. The solution may be sprayed on the plate 33 in which each of the openings 34 and the region 93 are covered by the mask. The region 94 on the plate 33 may be also coated with silicon disperse liquid.

According to the above fifth embodiment, when the bubble is projected from each of the openings 34, the ink 28 is prevented from extending in direction parallel to the surface of the plate 33 by the region 94 coated with the material having a high ink repellence property.

Figure 30:
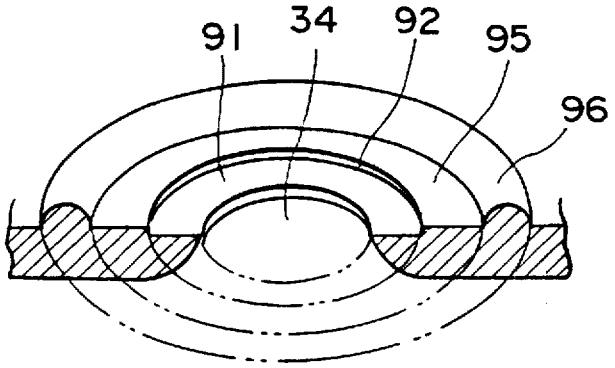
FIG. 30 is a diagram illustrating a ring-shaped wall formed around each of the openings on a plate provided in an ink jet recording head according to a sixth embodiment of the present invention.
Figure 31A:
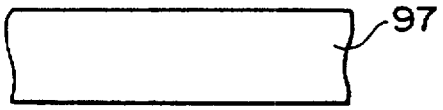
FIG.31A PRIOR ART
FIG. 31(*a*)–31(*f*) are is a diagram illustrating a process for forming the plate having the ring-shaped wall shown in FIG. 30.
Figure 31B:
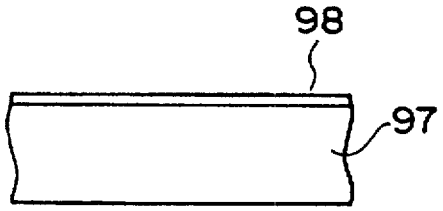
FIG.31B PRIOR ART
Figure 31C:
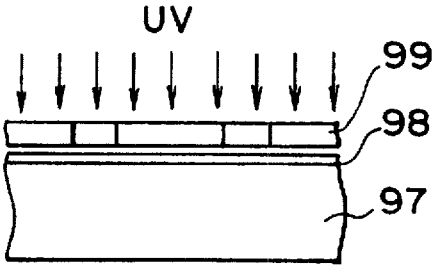
FIG.31C PRIOR ART
Figure 31D:
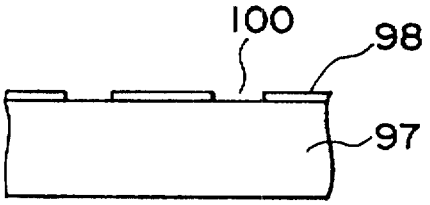
FIG.31D PRIOR ART
Figure 31E:
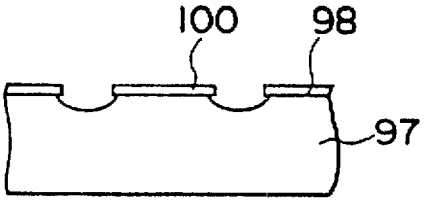
FIG.31E PRIOR ART
Figure 31F:
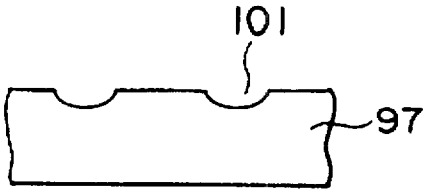
FIG.31F PRIOR ART

A description will now be given, with reference to FIGS. 30 and 31, of a sixth embodiment of the present invention. In the sixth embodiment, a ring-shaped wall (a convex portion) 96 is formed so as to surround each of the openings 34 on the plate 33, as shown in FIG. 30. In FIG. 30, the concave portion 91 is formed around each of the openings 34 in the same manner as that shown in FIGS. 25 and 26. As a result, a flat surface 95 is formed between the concave portion 91 and the ring-shaped wall 96.

The ring-shaped wall 96 is formed by the photo-electroforming method, as shown in FIG. 30.

In FIG. 30, (*a*) shows a base 97 made of stainless steel. The surfaces of the base 97 are polished.

In FIG. 30, (*b*) shows a state in which a film 98 of the photoresist is formed on the base 97 by the dipping method or the spin-coating method.

In FIG. 30, (*c*) shows a state in which a photo-mask 99 having a ring-shaped opening pattern corresponding to the ring-shaped wall 96 is provided on the surface of the photoresist film 38 and the photoresist film 38 is exposed to ultraviolet rays (UV).

In FIG. 30, (*d*) shows a state in which the photoresist film 98 is developed and openings 100 are formed on the photoresist film 98.

In FIG. 30, (*e*) shows a state in which exposure portions of the base 97 are etched.

In FIG. 30 (*f*) shows a state in which the remaining photoresist film 98 is removed from the base 97 and a ring-shaped concave portion 101 is formed on the base 97.

The base 97 on which the concave part 101 is formed is substituted for the stainless steel base 51 in a process shown in FIGS. 13, 28A and 28B. As a result, an Ni-layer is deposited on the surface of the base 97, and the Ni-layer having the ring-shaped wall 96 corresponding to the ring-shaped concave portion 101 and the concave portion 91 is obtained. That is, the plate 33 having the ring-shaped wall 96 and the concave portion both of which surround each of the openings 34 is formed. In this case, the depth of the ring-shaped concave portion 101 corresponds to the height of the ring-shaped wall 96.

According to the sixth embodiment, when the air bubbles 36 are projected from adjacent openings 34, the ink 28 is prevented, by the ring-shaped wall 96, from extending in directions parallel to the surface of the plate 33. Thus, even if the heater elements adjacent to each other are simultaneously driven, the air bubbles 36 projected from adjacent openings 34 are prevented from affecting each other.

A region outside of the concave portion 91 in the fourth embodiment and a region outside of the ring-shaped wall 96 in the sixth embodiment may be coated with the material having a high ink repellence property.

The following Experiments of the printing in which the ink jet recording heads having the plate 33 described in the fourth through sixth embodiments were utilized were carried out.

Experiment 4

Experiment 4, a dot image was recorded on a recording sheet under the following conditions.

SIZE OF HEATER ELEMENT 23: 100 μm×100 μm

DIAMETER OF OPENING 34: ϕ240 μm

THICKNESS OF PLATE 33: 70 μm

RESISTANCE OF HEATER ELEMENT 23: 122Ω

DRIVING VOLTAGE: 30 V

PULSE WIDTH: 7 μsec.

CONTINUOUS DRIVING FREQUENCY: 2.1 kHz

INK: INK USED IN DESK JET (Hewlett Packard COMP.)

In the recording head having the plate 33 provided with the openings 34 and the concave portion 91 which was formed around each of the openings 34 by the electroforming method, two heater elements 23 were simultaneously driven. The diameter of the concave portion 91 was o 380 μm. The results with respect to various depths of the concave portion 91 are indicated in Table-7.

TABLE 7

| No. | DEPTH (μm) | BUBBLES | STABILITY |
|---|---|---|---|
| 1 | 0 (NO CONCAVE PORTION) | CONTACT | x |
| 2 | 0.1 | CONTACT | x |
| 3 | 0.2 | CONTACT | x |
| 4 | 0.3 | SEPARATE | ○ |
| 5 | 0.4 | SEPARATE | ○ |
| 6 | 0.5 | SEPARATE | ○ |
| 7 | 1.0 | SEPARATE | ○ |

In Table-7, a judgment symbol "x" in the column "STABILITY" represents that air bubbles 36 projected from adjacent openings 34 were brought into contact with each other and droplets were unstably jetted. A judgment symbol "○" in the column "STABILITY" represents that air bubbles 36 projected from adjacent opening were separate from each other and droplets were stably jetted.

Experiment 5

Experiment 5, the ink jet recording head was driven under the same conditions as Experiment 4. The plate 33 in which the ring-shaped wall 96 surrounding each of the openings 34 was formed by the electroforming method was utilized. The inner diameter of the ring-shaped wall 96 was ø 370 μm and the outer diameter of the ring-shaped wall 96 was ø 375 μm. The jetting results are indicated in Table-8.

TABLE 8

| No. | HEIGHT (μm) | BUBBLES | STABILITY |
|---|---|---|---|
| 1 | 0.1 | CONTACT | x |
| 2 | 0.2 | CONTACT | x |
| 3 | 0.3 | SEPARATE | ○ |
| 4 | 0.4 | SEPARATE | ○ |
| 5 | 0.5 | SEPARATE | ○ |
| 6 | 1.0 | SEPARATE | ○ |

In Table-8, a judgment symbol "x" represents that droplets were unstably jetted, and a judgment symbol "○" represents that droplets were stably jetted, in the same manner as that in Table-7.

Experiment 6

In Experiment 6, the ink jet recording head was driven under the same conditions as that in Experiments 4 and 5, and four types of plates 33 were used. In the first plate 33 (No. 1), both the concave portion 91 and the ring-shaped wall 96 were formed around each of the openings 34, as shown in FIG. 30. In the second plate 33 (No. 2), there were neither the concave portion 91 nor the ring-shaped wall 96 and the surface of the plate 33 was coated with a material made of fluororesin except to the region 93 surrounding each of the openings 34, as shown in FIG. 29. The diameter of each of the openings 34 was ø240 μm, and the diameter of the region 93 was ø 350 μm. In the third plate 33 (No. 3), the concave portion 91 having a depth of 0.2 um was formed around each of the openings 34 and the region 94 outside the concave portion 91 was coated with a material made of fluororesin. In the fourth plate 33 (No. 4), only the ring-shaped wall 96 having a height of 0.2 um was formed around each of the openings 34 and the outside of the ring-shaped wall 96 was coated with a material made of fluororesin. The jetting results with respect to various heights of the ring-shaped wall 96 are indicated in Table-9.

TABLE 9

| No. | BUBBLES | STABILITY |
|---|---|---|
| 1 | CONTACT | x |
| 2 | PRACTICALLY SEPARATE | ○ |
| 3 | SEPARATE | ○ |
| 4 | SEPARATE | ○ |

According to Experiments 4, 5 and 6, in a case where the palate 33 having concave portion 91 or the ring-shaped wall 96 was used, the droplets were stably jetted under a condition in which the depth of the concave portion 91 or the height of the ring-shaped wall 96 was equal to or greater than 0.3 μm. In a case where the region 94 was coated with a material having a high ink repellence property, even if there are neither the concave portion 91 nor the ring-shaped wall 96, the droplets were stably jetted.

A description will now be given of an example of a structure of the ink jet recording apparatus with reference to FIGS. 32 through 36.

Figure 32:
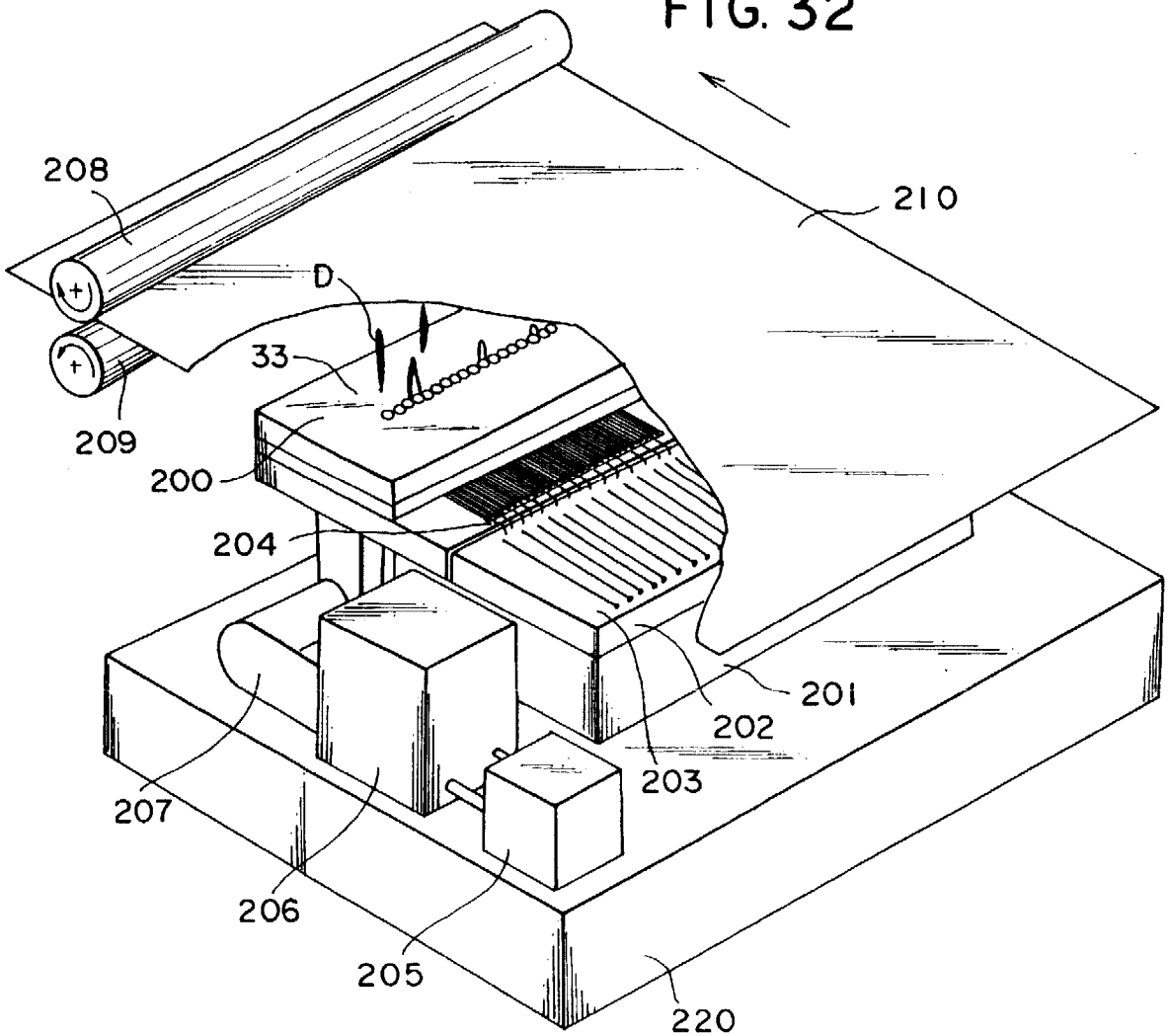
FIG. 32 is a perspective view illustrating an embodiment of an ink jet recording apparatus according to the present invention.

Referring to FIG. 32, an ink jet recording head 200 having the plate 33 on which the openings are formed so as to be arranged in a line is mounted on a supporting block 201 fixed on a base 220. A circuit board 202 is also mounted on the supporting block 201. The electrodes in the ink jet recording head 200 and lead lines formed on the circuit board 202 are connected to each other by conductor wires 204. An ink supply system including a pump 205, an ink supply controller 206 and an ink supply pipe 206 is provided on the base 220. The ink is supplied from the ink supply system to the ink jet recording head 200. The depth of the ink in the ink jet recording head 200 is controlled at a constant value by the ink supply controller 206. A recording sheet 210 is arranged so as to face the plate 33 of the ink jet recording head 200 and moved by the rollers 208 and 209 in a predetermined direction shown by an arrow in FIG. 32. When the recording sheet 210 is moved at a predetermined speed, droplets of the ink ejected from the openings of the plate 33 are adhered on the recording sheet 210 so that a dot image is formed on the recording sheet 210.

Figure 33:
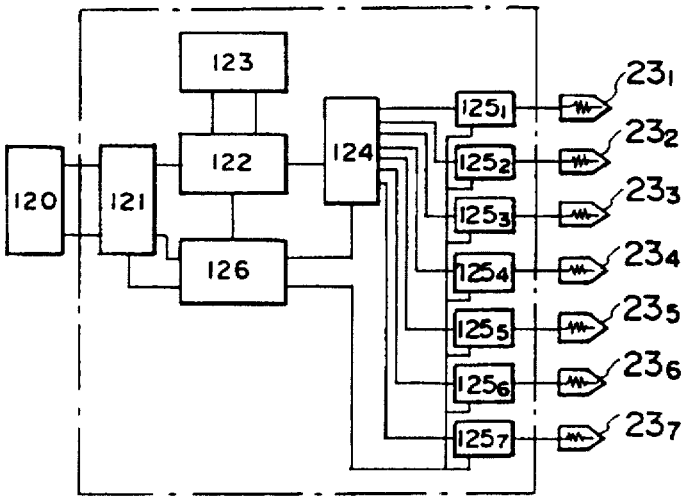
FIG. 33 PRIOR ART
FIG. 33 is a block diagram illustrating a control circuit for controlling the ink jet recording head.

FIG. 33 indicates a control circuit for controlling the ink jet recording head 200. The control circuit is formed on the circuit board 202. Referring to FIG. 33, the control circuit has an interface circuit 121 coupled to a computer 120, a data generator 122, a character generator 123, a buffer circuit 124 and a controller 126. Drivers $125_1$–$125_7$ drive the heater elements $23_1$–$23_7$ in accordance with dot data stored in the buffer circuit 124.

Figure 34:
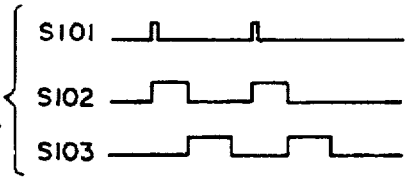
FIG. 34 PRIOR ART
FIG. 34 is a timing chart illustrating an operation of a buffer circuit provided in the control circuit shown in FIG. 34.

The buffer circuit 124 operates as shown in FIG. 34. That is, a data signal $S_{102}$ output from the data generator 122 is stored in the buffer circuit 124 in synchronism with a character clock signal $S_{101}$. The data signal stored in the buffer circuit 124 is supplied to the drivers $125_1$–$125_7$ as shown by $S_{103}$ in FIG. 34.

Figure 35:
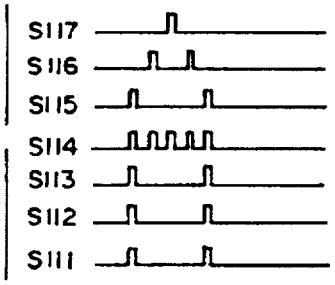
FIG. 35 PRIOR ART
FIG. 35 is a timing chart illustrating operations of drivers provided in the control circuit shown in FIG. 34.
Figure 36:
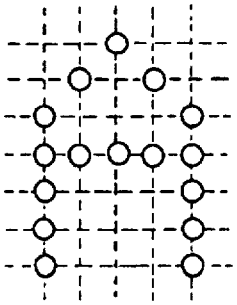
FIG. 36 PRIOR ART
FIG. 36 is a diagram illustrating a dot image formed by the ink jet recording head.

In a case where the heater elements $23_1$–$23_7$ are respectively driven, for example, by driving signals $S_{111}$–$S_{117}$ shown in FIG. 35, a dot image corresponding to a character "A" is formed on the recording sheet 210, as shown in FIG. 36.

In the above embodiments, each of the heater elements 23 supplies energy to the ink to generate an air bubble. The energy can be also supplied to the ink by a pulse laser or an electric discharging.

The present invention is not limited to the aforementioned embodiments, and variations and modifications may be made without departing from the scope of the claimed invention.

What is claimed is:

1. An ink-jet recording apparatus comprising a recording head including, a base, a plate on which a plurality of openings are formed, a chamber to be filled with ink being formed between said base and said plate;

a bubble-generating means having a heating area provided in the ink chamber so as to face each of the openings of said plate so that in response to a flow pulse, a vapor bubble is generated on the heating area and grows in the direction of the opposite opening;

driving means coupled to said recording head for supplying the flow pulse to said bubble generating means for activating said bubble generating means and generating the vapor bubble in accordance with image data supplied from an external unit; and an area of each of said openings of said plate being greater than said operating area of said bubble-generating means, wherein when said driving means activates said bubble-generating means an ink droplet is ejected by the vapor bubble out of a corresponding opening of said plate, and wherein (a) the driving means supplies the flow pulse to the respective bubble-generating means, the flow pulse having a pulse voltage and a pulse duration which generate a vapor bubble which grows beyond an upper rim of the respective opening to a height which, as measured from the upper rim of the respective opening to an outer end of the vapor bubble, attains a value which is larger than a distance between the base and the plate, the attainment of this height of the vapor bubble ending the pulse duration, (b) each bubble-generating means is surrounded by stopping blocks, by means of which the pressure generated with the development of the respective vapor bubble is laterally dispersed, (c) the plate is terrassed like stairs at its outwardly facing surface concentrically about each opening such that with increasing radial distance from the respective opening concentrically surrounding regions increase from a level springing back opposite the level of the surface of the plate directed outwardly to the level of the surface of the plate directed outwardly, and (d) that the region lying radially outwardly of the concentrically surrounding regions is surrounded concentrically by an annular wall exceeding the level of the surface directly outwardly and with a cross-section with rounded-off outer contour.

2. An apparatus according to claim 1, wherein each of the openings of the plate is a circle.

3. An apparatus according to claim 2, wherein the distance between adjacent openings of the plate is greater than one tenth of a diameter of each of said openings.

4. An apparatus according to claim 1, wherein the openings are arranged along a plurality of lines so as to zigzag.

5. An apparatus according to claim 4, wherein the distance between adjacent openings of the plate is greater than one tenth of a diameter of each of said openings.

6. An apparatus according to claim 1, wherein the distance between adjacent openings of the plate is greater than one tenth of a diameter of each of said openings.

7. An apparatus according to claim 1, wherein the thickness of said plate at a position close to each of said openings is less than a square root of a region of each of said openings.

8. An apparatus according to claim 1, wherein the depth of a stair-like terrassed portion is equal to or greater than 0.3 μm.

9. An apparatus according to claim 1, wherein the region facing outwards of the plate outside of the regions surrounded by the annular wall is coated with a material that has a high ink-repellence property.

10. An apparatus according to claim 1, wherein the height of the annular wall is equal to or greater than 0.3 μm.

* * * * *

UNITED STATES PATENT AND TRADEMARK OFFICE

CERTIFICATE OF CORRECTION

PATENT NO. : 5,754,202

DATED : May 19, 1998

INVENTOR(S) : Takuro Sekiya, e.t al.

It is certified that error appears in the above-indentified patent and that said Letters Patent is hereby corrected as shown below:

Cover page, item [54] and col. line 1, change

"INK JET RECORDING APPARATUS" to

--INK JET RECORDING APPARATUS AND METHOD--.

Signed and Sealed this

Twenty-eighth Day of July, 1998

*Attest:*

Bruce Lehman

BRUCE LEHMAN

*Attesting Officer*

*Commissioner of Patents and Trademarks*